United States Patent [19]

Ohkubo et al.

[11] 4,013,841

[45] Mar. 22, 1977

[54] FOUR-CHANNEL STEREO RECEIVER

[75] Inventors: Tsuneo Ohkubo, Katano; Yoshio Horiike, Neyagawa, both of Japan

[73] Assignee: Matsushita Electric Industrial Co., Ltd., Osaka, Japan

[22] Filed: July 21, 1975

[21] Appl. No.: 597,331

Related U.S. Application Data

[63] Continuation of Ser. No. 316,488, Dec. 19, 1972, abandoned.

[30] Foreign Application Priority Data

| | | |
|---|---|---|
| Dec. 23, 1971 | Japan | 46-524 |
| Dec. 27, 1971 | Japan | 47-615 |
| Feb. 1, 1972 | Japan | 47-11659 |
| Feb. 7, 1972 | Japan | 47-13736 |
| Feb. 8, 1972 | Japan | 47-14260 |
| Feb. 8, 1972 | Japan | 47-14261 |
| Feb. 8, 1972 | Japan | 47-14262 |
| Apr. 18, 1972 | Japan | 47-38992 |
| Apr. 18, 1972 | Japan | 47-38993 |
| Apr. 18, 1972 | Japan | 47-38994 |
| Apr. 18, 1972 | Japan | 47-38995 |
| Apr. 22, 1972 | Japan | 47-40560 |
| Apr. 22, 1972 | Japan | 47-40561 |
| Apr. 25, 1972 | Japan | 47-41965 |
| Apr. 25, 1972 | Japan | 47-41966 |
| July 28, 1972 | Japan | 47-75673 |
| July 29, 1972 | Japan | 47-76118 |
| July 31, 1972 | Japan | 47-78511 |
| Aug. 15, 1972 | Japan | 47-82006 |

[52] U.S. Cl. ..... 179/15 BT; 179/100.4 ST

[51] Int. Cl.[2] ..... H04H 5/00

[58] Field of Search ..... 179/15 BT, 1 G, 16 Q, 179/100.1 TD, 100.4 ST; 325/36

[56] References Cited

UNITED STATES PATENTS

| | | | |
|---|---|---|---|
| 3,569,633 | 3/1971 | Brahman | 179/15 BT |
| 3,573,382 | 4/1971 | Feit et al. | 179/15 BT |
| 3,617,641 | 11/1971 | Feit et al. | 179/15 BT |
| 3,662,113 | 5/1972 | Vonrecklinghausen | 179/15 BT |
| 3,679,832 | 7/1972 | Halpern | 179/15 BT |
| 3,708,623 | 1/1973 | Dorren | 179/15 BT |
| 3,711,652 | 1/1973 | Metro | 179/15 BT |
| 3,721,766 | 3/1973 | Hilbert | 179/15 BT |
| 3,754,099 | 8/1973 | Takaoka | 179/15 BT |
| 3,787,629 | 1/1974 | Limberg | 179/15 BT |

*Primary Examiner*—Douglas W. Olms
*Attorney, Agent, or Firm*—Stevens, Davis, Miller & Mosher

[57] ABSTRACT

A four-channel stereo receiver capable of making the four-channel indication, and automatically changing over the four-channel mode operation and the two-channel mode operation or muting the monaural and the two-channel signal, based on the presence or absence of at least one of the second and the third sub-channel signals, and the second pilot signal included in the four-channel composite signal but not in the two-channel composite signal.

34 Claims, 33 Drawing Figures

FOUR-CHANNEL STEREO RECEIVER

This is a continuation of application Ser. No. 316,488, filed Dec. 19, 1972, now abandoned.

This invention relates to a four-channel stereo receiver and more particularly to a four-channel stereo receiver capable of automatically switching between four-channel and two-channel operation.

It is perferable that the four-channel stereo broadcasting is compatible with the two-channel stereo broadcasting. Then, in the case of receiving a four-channel and a two-channel broadcasting in a four-channel stereo receiver, it will be convenient if the receiver indicates whether the broadcasting is four-channel or two-channel, and automatically changes the four-channel operation and the two-channel operation according to the received signal, or exclusively selecting the four-channel broadcasting and muting the monaural and the two-channel signals.

An object of this invention is to provide a four-channel stereo receiver which can extract a component of the four-channel stereo composition signal not included in the two-channel stereo composite signal, and on the presence of said signal actuate the four-channel stereo broadcasting indicator, automatically change over the two-channel operation to the four-channel operation, and mute the monaural and the two-channel signals.

Another object of this invention is to provide a four-channel stereo receiver comprising a first detector circuit for detecting at least one component of the four-channel composite signal not included in the two-channel composite signal, and a second detector circuit for detecting that component which is different from said one component, the output of the first detector circuit being picked up and the receiver being carried into the four-channel operation state only when the output of said second detector circuit becomes above or below a certain level.

A further object of this invention is to provide a four-channel stereo receiver, the four-channel operation of which is switched on and off by the presence or absence of the signal energy which is orthogonal to the third sub-channel signal of the four-channel composite signal.

A yet further object of this invention is to provide a four-channel stereo receiver, the four-channel operation of which is switched on and off by the presence or absence of the signal energy, the frequency of which is an integer times as large as the sub-channel signal of the two-channel signal.

According to an embodiment of this invention, there is provided a four-channel stereo receiver for demodulating the four-channel composite signal consisting of the first signal portion including almost the same components as the two-channel composite signal including the main channel signal, the sub-channel signal formed by suppressed-carrier amplitude modulation, and the pilot signal, and the second signal portion consisting of components not included in said two-channel signal, comprising a detector circuit for detecting at least one component of the four-channel signal not included in the two-channel signal, and a control circuit including a switching circuit operated by the output of said detector circuit whereby the demodulating receiver is automatically made operative when a four-channel signal is received and non-operative when a two-channel signal is received.

Now, the embodiments of the four-channel stereo receiver according to this invention will be described referring to the accompanying drawings in which.

Figure 1:
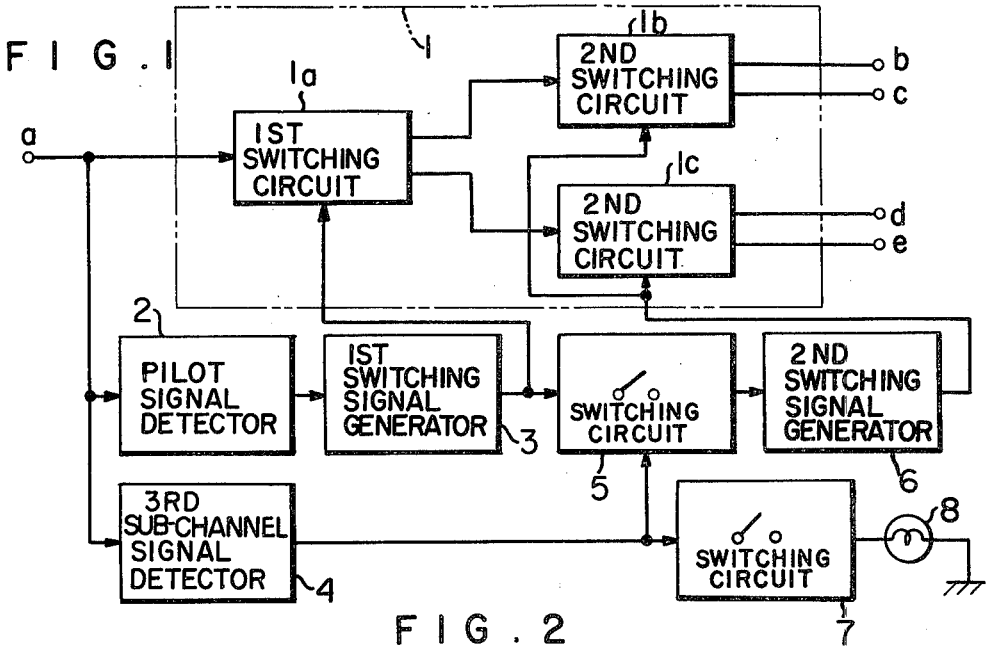
FIG. 1 is a block-diagram of an embodiment of this invention.
Figure 2:
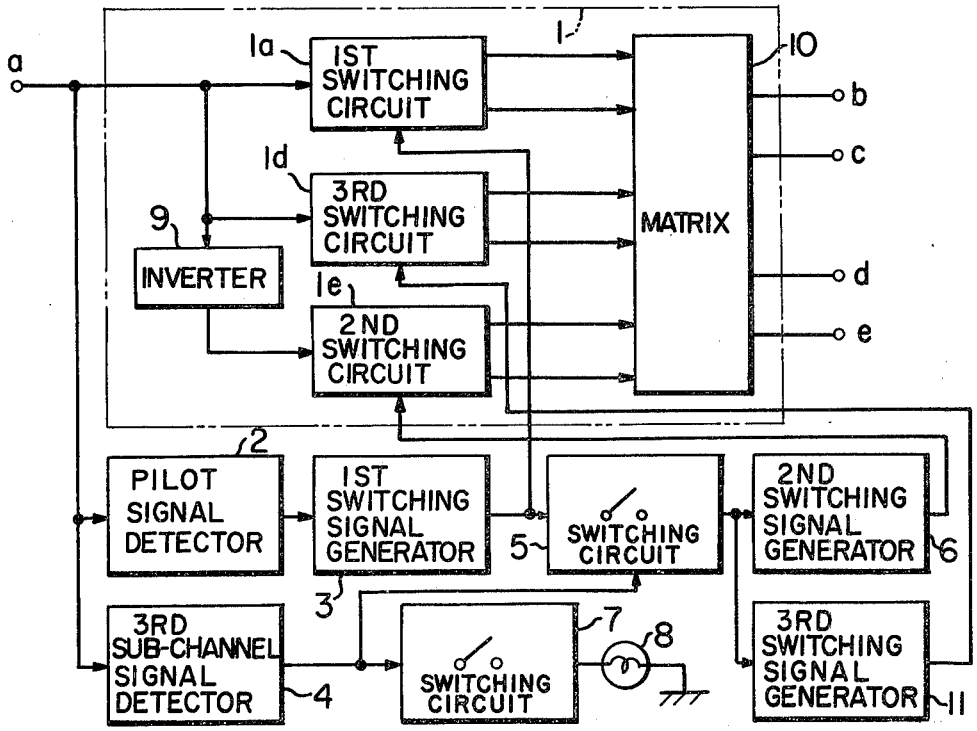
FIGS. 2 and 3 are block-diagrams of other embodiments of this invention.
Figure 3:
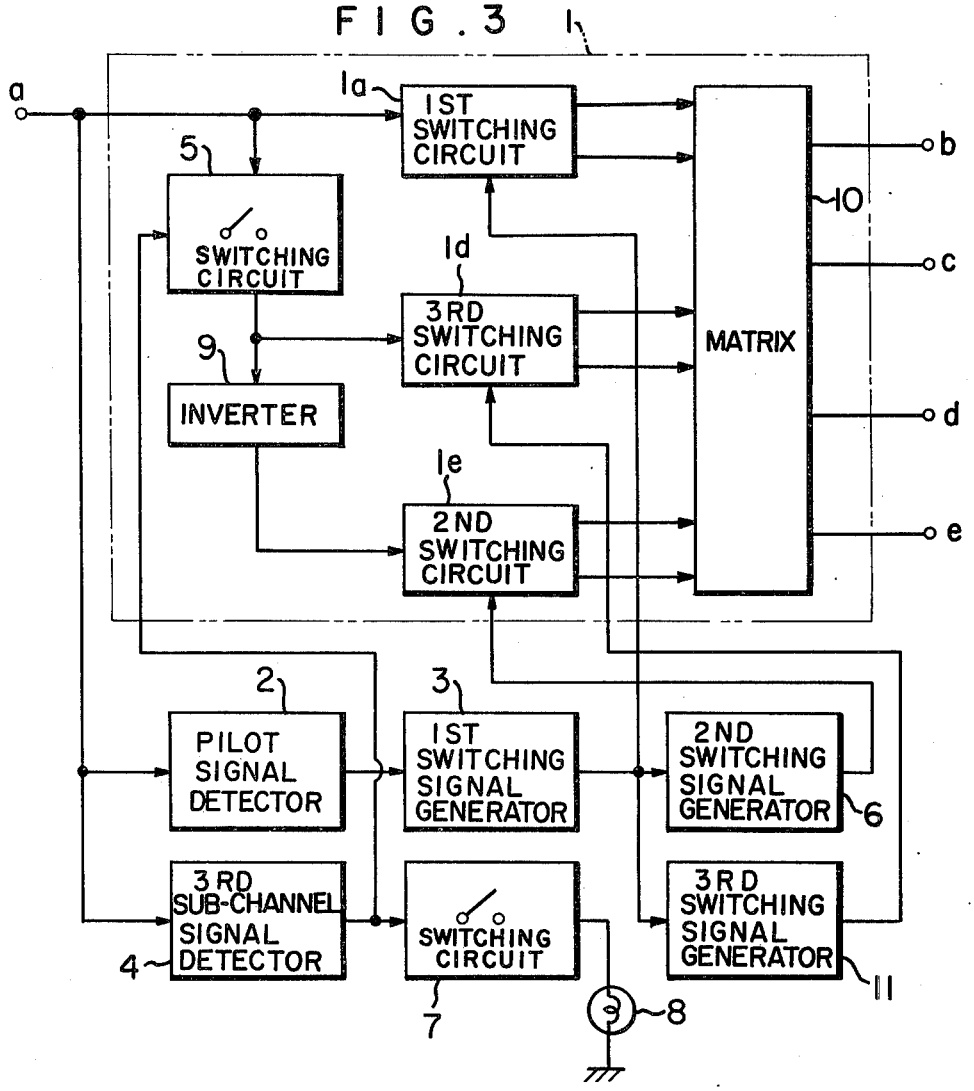
Figure 6:
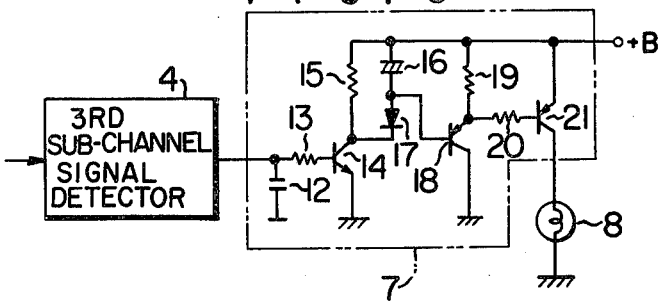
Figure 7:
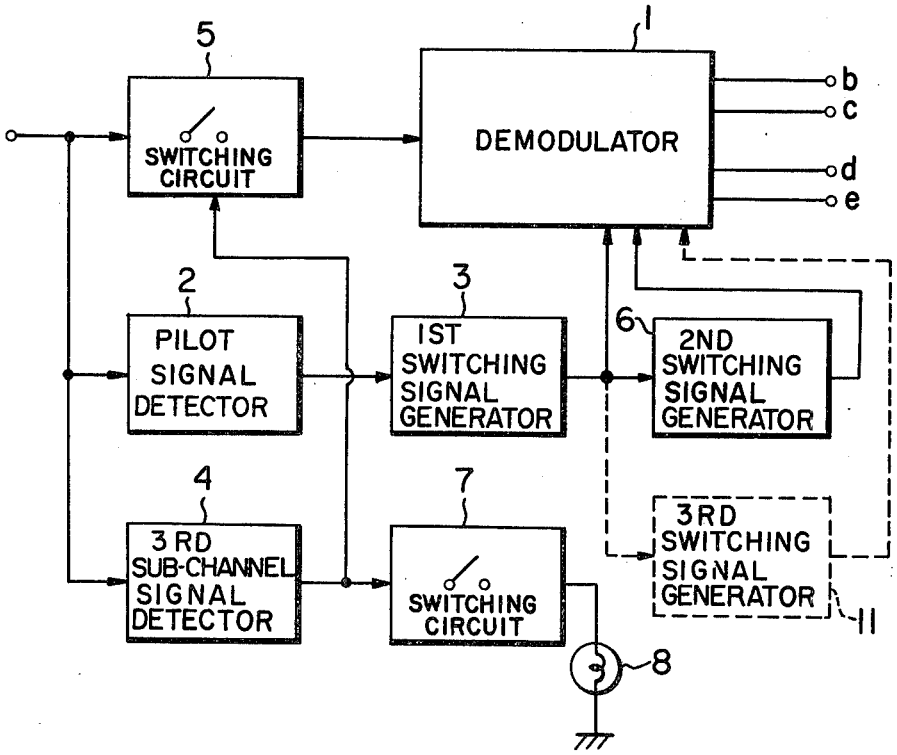
Figure 8:
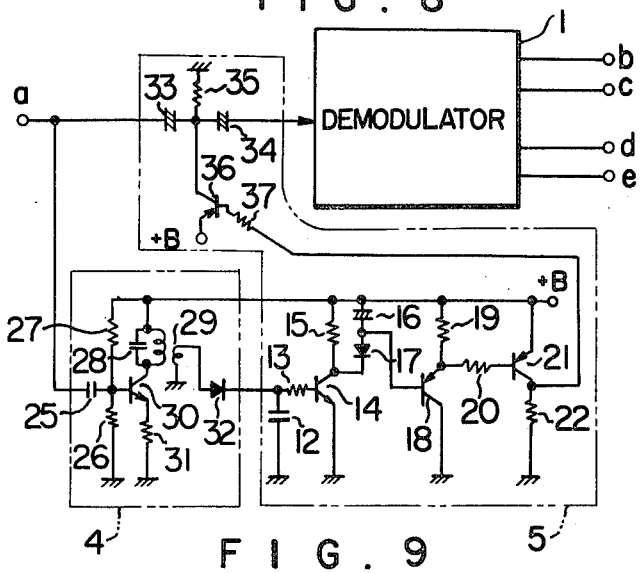
Figure 9:
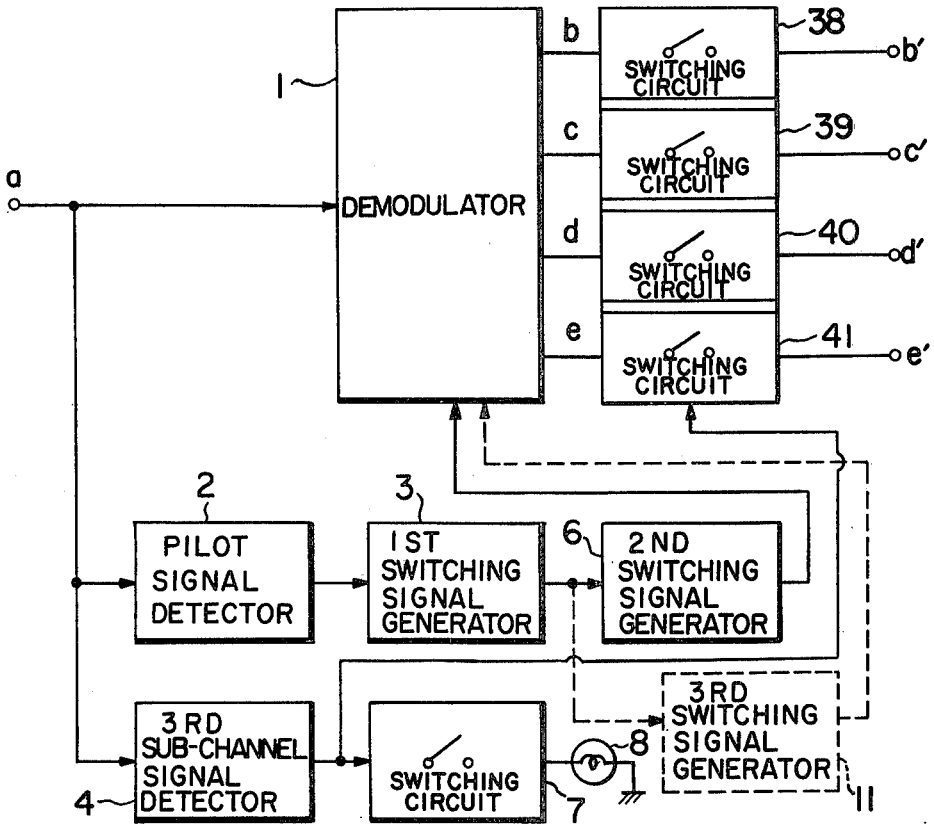
Figure 10:
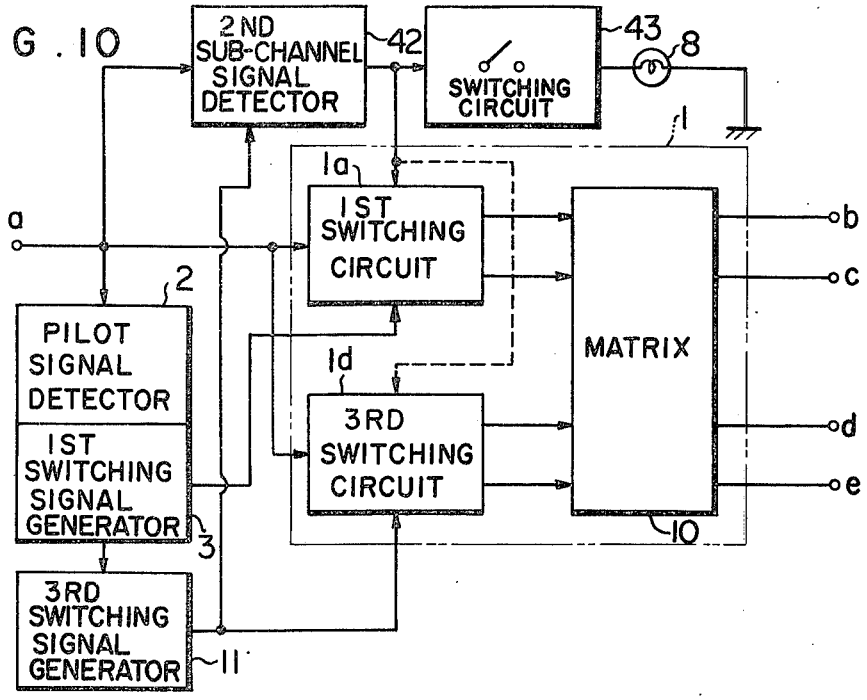
Figure 11:
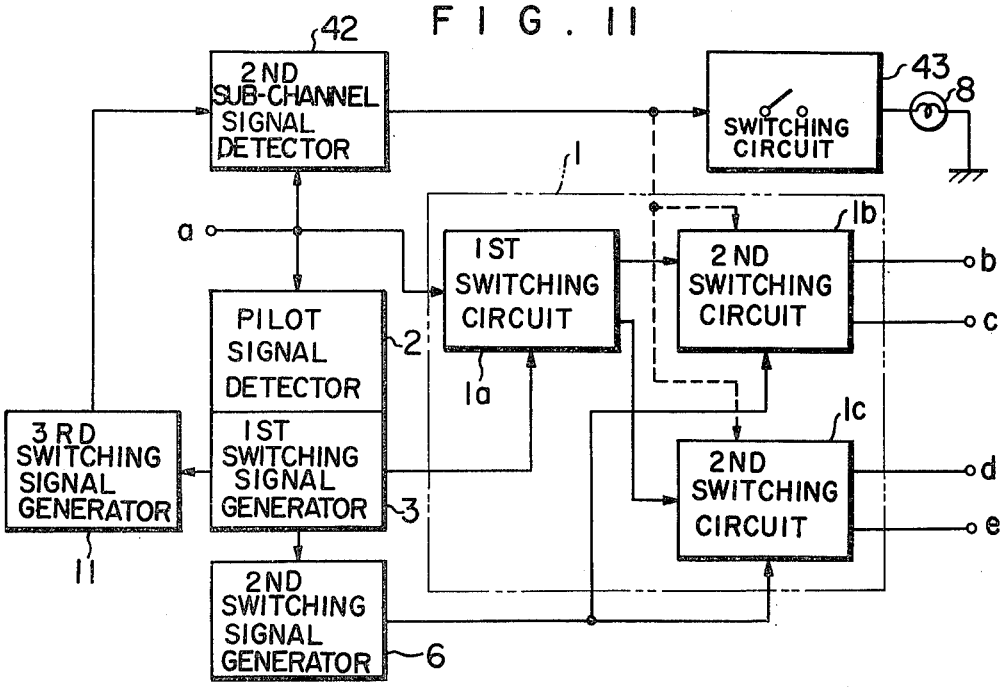
Figure 12:
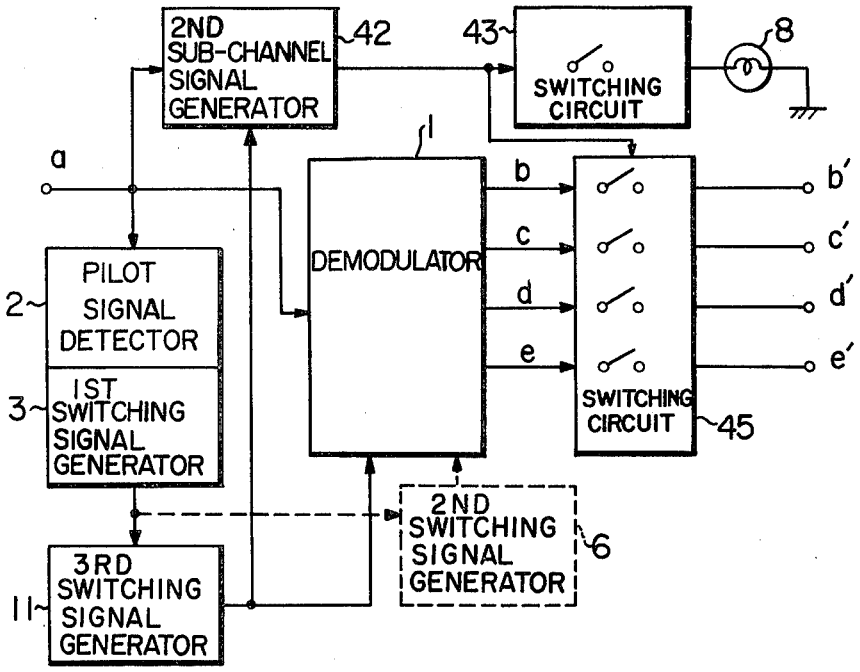
Figure 13:
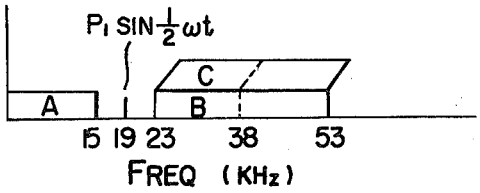
Figure 14:
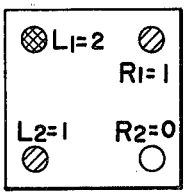
Figure 17:
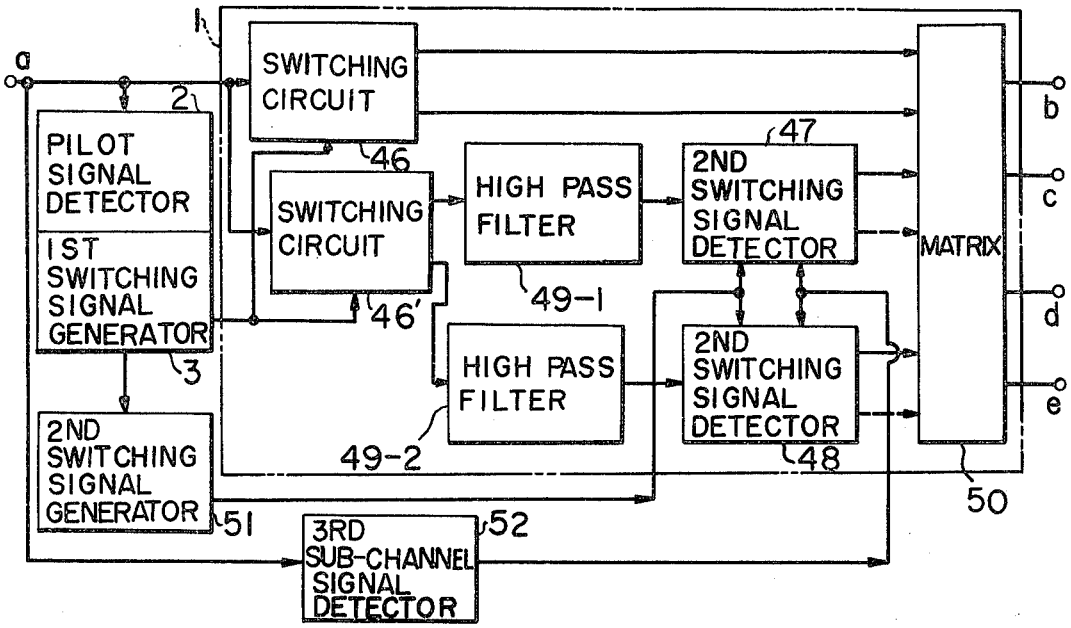
Figure 18:
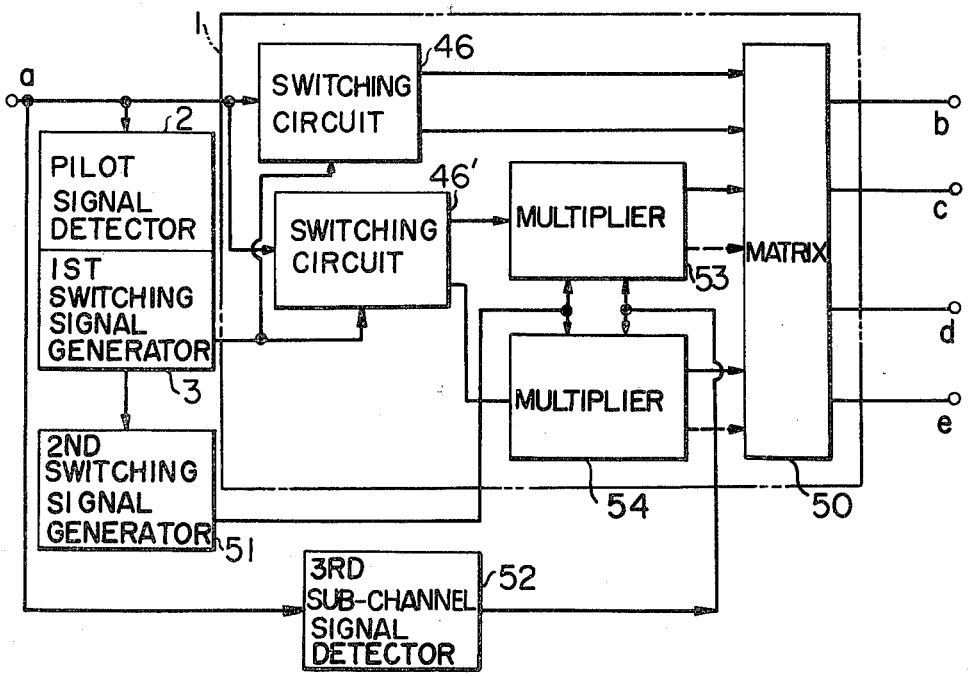
Figure 19:
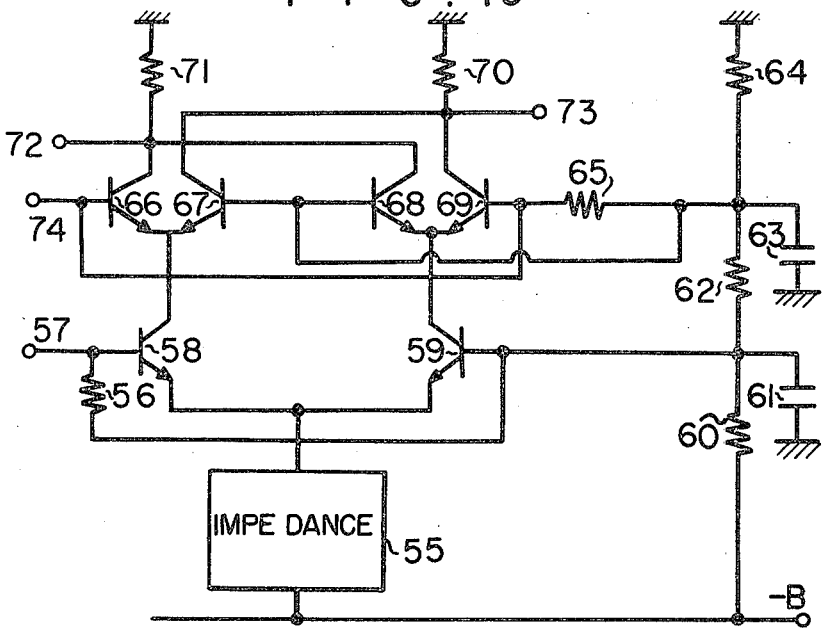

FIGS. 4 and 5*a* to 5*c* show examples of the frequency spectrum of the two-channel and the four-channel composite signals;

FIG. 6 is a concrete example of the switching circuit used im the embodiments of FIGS. 1 to 3;

FIG. 7 is a block diagram of another embodiment of this invention;

FIG. 8 is a block diagram of a concrete example of the switching circuit and the third sub-channel signal detector circuit;

FIG. 9 is a block diagram of another embodiment of this invention which carries out the change-over under the control of the third sub-channel signal;

FIGS. 10 to 12 are block diagrams of other embodiments of this invention which carry out the change-over by the second sub-channel signal;

FIG. 13 shows an example of the frequency spectrum of another four-channel composite signal;

FIG. 14 illustrates the demodulation of the signal of FIG. 13;

FIGS. 15 to 18 are block diagrams of other embodiments which carry out the change-over under the control of the second or third sub-channel signals;

FIG. 19 is a block diagram of a concrete example of the multiplier of FIGS. 16 to 18, FIGS. 20 to 24 are block diagrams of other embodiments of this invention which achieve the change-over by the second pilot signal; and FIGS. 25 to 31 are block diagrams of other embodiments of this invention which achieve the change-over by one component of the four-channel composite signal not contained in the two-channel signal and the signal component except said component.

Throughout the figures, similar numerals indicate similar parts.

Figure 4:
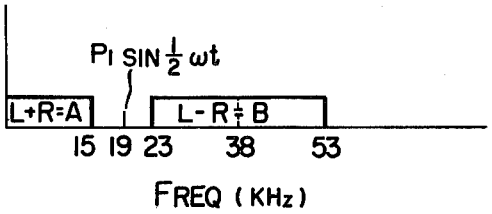

In FIG. 1, the signal detected in an f.m. tuner is applied to an input terminal *a*. The two-channel stereo composite signal S($t$) applied to the input terminal *a* can be represented by $$S(t) = (L + R) + (L - R) \sin \omega t + P_1 \sin \tfrac{1}{2}\omega t \qquad (1),$$

where $L$ and $R$ are left and right signals in stereophonic relation, the first term represents the main channel signal, the second term the sub-channel signal, the third term the pilot signal, and $\omega/2\pi = 38$ KHz (cf. FIG. 4). The monaural signal can be represented by the main channel signal of the first term in equation (1).

Figure 5A:
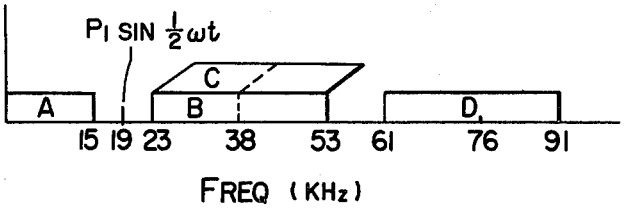
Figure 5B:
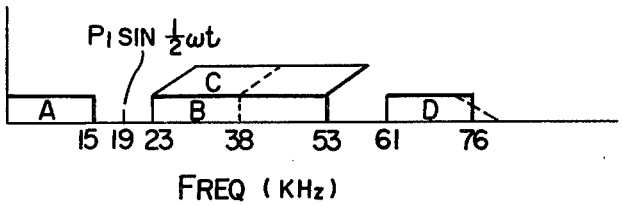
Figure 5C:
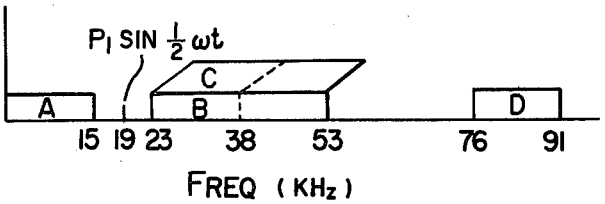

An example of the four-channel stereo composite signal M($t$) is written by $$M(t) = A + B \sin \omega t + C \cos \omega t + D \sin 2\,\omega t + P_1 \sin \tfrac{1}{2}\omega t \qquad (2),$$

where A, B, C, and D are combinations of four signals in stereophonic relation, e.g.

$$A = (L_1 + L_2 + R_1 + R_2) \qquad (3),$$

$$B = (L_1 + L_2 - R_1 - R_2) \qquad (4),$$

$$C = (L_1 + R_1 - L_2 - R_2) \text{ or } (L_1 + R_2 - L_2 - R_1) \qquad (5),$$

$$D = (L_1 + R_2 - L_2 - R_1) \text{ or } (L_1 + R_1 - L_2 - R_2) \quad (6),$$

in which $L_1$ and $L_2$ are left front and left rear signals, $R_1$ and $R_2$ are right front and right rear signals, the first term in equation (2) represents the main channel signal, the second term represents the first sub-channel signal which results from suppressed-carrier amplitude modulation signal, the third term represents the second sub-channel signal which is orthogonal to the first sub-channel signal, the fourth term represents the third sub-channel signal which results from suppressed-carrier amplitude modulation having a frequency two times as large as that of the first sub-channel signal and may be a single side band signal, and the fifth term represents the pilot signal (cf. FIG. 5*a*). When one sets $(L_1 + L_2) = L$ and $(R_1 + R_2) = R$ in the first and second terms of equation (2), the first and second terms in equations (1) and (2) become equal respectively. Then, the two composite signals can be received compatibly. The frequency range for equation (1) extends to 53 KHz as shown in FIG. 4, but that for equation (2) extends up to 91 KHz as shown in FIG. 5*a*. When the fourth term in equation (2) has only a single side band or vestigial sideband, the frequency range extends as shown in FIG. 5*b* or 5*c*.

When the four-channel stereo composite signal represented by equation (2) is applied to the input terminal *a*, this signal is transmitted to a first switching circuit 1*a* of a demodulator 1, a pilot signal detector circuit 2 and a third sub-channel signal detector circuit 4. The pilot signal is detected in the pilot signal detector 2 and coupled to a first switching signal generator 3 which generates a first switching signal (having a frequency of 38 KHz which is equal to that of the first sub-carrier wave). and applies it to the first switch circuit 1*a* as well as to a switching circuit 5 of control circuits. In the first switching circuit 1*a*, the stereo composite signal is switched on and off by the first switching signal (38 KHz) and then supplied to the second switching circuits 1*b* and 1*c* of demodulated 1. On the other hand, the third sub-channel signal is detected in the third sub-channel detector circuit 4 and converted into a d.c. signal. By this output, the switches 5 and 7 of the control circuits are switched on. When one switch circuit 7 is switched on, a four-channel stereo indicator 8 is turned on. When the other switch circuit 5 is turned on, the output of the first switching signal generator circuit 3 is applied to a second switching signal generator circuit 6 through the switch circuit 5. The second switching signal generator circuit 6 generates a second switching signal (having a frequency of 76 KHz which is equal to that of the third sub-carrier wave) and applies it to the second switching circuits 1*b* and 1*c* of demodulator 1 so as to switch again the output of the first switching circuit 1a by the second switching signal. As a result, at output terminals *b*, *c*, *d*, and *e*, signals $L_1$, $L_2$, $R_1$, and $R_2$ appear.

In the case where the two-channel stereo composite signal represented by equation (1) is applied to the input terminal *a*, because the stereo composite signal includes a pilot signal, it is switched by the first switching signal (38 KHz) in the first switching circuit 1*a* and produces separated left and right signals L and R at the output terminals of the circuit 1*a*. In a two-channel stereo composite signal, there is no third sub-channel signal located above the frequencies of the two-channel composite signal in the frequency spectrum, unlike the case of a four-channel stereo composite signal as represented by equation (2). Thus, no output appears from the third sub-channel signal detector circuit 4. Accordingly, the switch circuits 5 and 7 are kept in the off-state, the indicator lamp 8 existing on the output side of said one switch circuit 7 is kept in the off-state, and the second switching signal generator circuit 6 connected to the other switch circuit 5 receives no input from the first switching signal generator 3 and hence generates no second switching signal at the output. Thus, the second switching circuits 1*b* and 1*c* do not perform switching action and allow the direct transmission of the output of the first switching circuit 1*a*. The left and right signals L and R appear at the output terminals *b* and *c*, and *d* and *e*, respectively.

As is described above, when a two-channel stereo composite is applied to the input terminal *a*, the second switching circuits 1*b* and 1*c* required in demodulation of a four-channel stereo composite signal becomes inactive and allow direct transmission of the input signal so that the signal to noise ratio (S/N ratio) of the signal hardly decreases.

FIG. 2 shows another embodiment using another stereo demodulator circuit in place of the demodulator circuit 1 of FIG. 1. In FIG. 2, the demodulator 1 comprises a first switching circuit 1*a* which is switched on and off by the first switching signal, a third switching circuit 1*d* which is switched on and off by the third switching signal having a phase 90° shifted from the first switching signal, and a second switching circuit 1*e* which is switched on and off by the second switching signal having a frequency twice as large as that of the first switching signal. A composite signal of the same phase is applied to the first and third switching circuits 1*a* and 1*d*, and one having an inverted phase by passing through a phase inverter 9 is applied to the second switching circuit 1*e*. The output signals of these switching circuits 1*a*, 1*d*, and 1*e* are, in the low frequency range, represented by $$L_1 + L_2,\ R_1 + R_2 \quad (7)$$

$$L_1 + R_1,\ L_2 + R_2 \quad (8)$$

$$L_1 + R_2,\ L_2 + R_1 \quad (9)$$

The signal represented by equation (7) is given by the first switching circuit 1*a*, and the signal represented by equations (8) and (9) are derived from the second and the third switching circuits 1*e* and 1*d*. The outputs of the second and the third switching circuits differ according to the contents of equations (5) and (6). The output of the second switching circuit 1*e* becomes of the opposite phase due to the existence of an inverter circuit 9 before the second switching circuit 1*e*. The outputs of these switching circuits 1*a*, 1*d*, and 1*e* are supplied to a matrix circuit 10 to obtain separated output signals $L_1$, $L_2$, $R_1$, and $R_2$ at output terminals *b*, *c*, *d*, and *e*. When a composite signal is arranged to have an inverted phase by passing through the inverter circuit 9 as is the case in FIG. 2, only addition is needed to generate four separated signals, whereas if all the input signals are given without inverting the phase in the inverter circuit 9, addition and subtraction are required to get four separated signals. In FIG. 2, a third switching signal generator circuit 11 generates signals which have a phase shift of 90° from that of the first switching signal (here, the third switching signal is equivalent to the second sub-carrier wave). When a four-channel composite signal is supplied to the circuit of FIG. 2, the switch circuits 5 and 7 of the control circuits are turned on, hence the indicator lamp 8 is turned on, and the second and the third switching signals are applied from the second and the third switching signal generating circuits 6 and 11 to the second and the third switching circuits 1*e* and 1*d*. When a two-channel composite signal is supplied to the circuit of FIG. 2, because of the absence of the third sub-channel signal the switch circuits 5 and 7 are turned off, then the indicator lamp 8 is turned off, no second and no third signal is generated in the second and the third switching signal generating circuits 6 and 11, hence no switching signal is applied to the second and the third switching circuit le and ld and no output can be derived therefrom (the second switching circuits 1*b* and 1*c* in FIG. 1 allow the direct transmission of an input signal in the absence of the switching signal, whereas the switching circuits 1*d* and 1*e* in FIG. 2 cut off any input signal in the absence of the switching signal), and therefore only the L and R signal of the output of the first switching signal 1*a* is applied to the matrix 10 under the application of a two-channel composite signal to output the left and right signals L and R from output terminals *b* and *c*, and *d* and *e*.

FIG. 3 shows another embodiment of this invention, in which the connection of the demodulator with the switching circuit 5 in FIG. 2 is altered. Namely, the first, the second and the third switch circuit 1*a*, 1*e*, and 1*d* are always applied with the first, the second and the third switching signals, and the switch circuit 5 is turned on under the application of a four-channel composite signal to apply the composite signal to the first, the second and the third switching circuits 1*a*, 1*e*, and 1*d* of demodulator 1 thereby providing four signals $L_1$, $L_2$, $R_1$, and $R_2$ from the output terminals *b*, *c*, *d*, and *e*. When a two-channel stereo composite signal is applied, the switch circuit 5 is turned off to prevent the composite signal from being applied to the second and the third switching circuits 1*e* and 1*d* and the L and R signal of the output of the first switching circuit 1*a* is arranged to output as the left and the right signals L and R from the output terminals *b* and *c*, and *d* and *e*.

A concrete example of the switch circuit 7 of the control circuits used in FIGS. 1, 2, and 3 is shown in FIG. 6, in which the dc signal derived from the third sub-channel signal detector circuit 4 is applied to the base of a transistor 14 and the collector output of the transistor 14 is connected to the base input of another transistor 18 through a diode 17 so as to on-off control the transistor 18. The third sub-channel signal appears only when modulation is present, but it will be inconvenient if the indicator 8 is cut off whenever the audio signal is absent. Thus, for keeping the on-state of the lamp 8 for a certain period (ca. 20 to 30 seconds) even after the third sub-channel signal has, it is arranged that when the transistor 14 is turned off, the diode 17 is turned off and hence the transistor 18 is not turned off unless a capacitor 16 has discharged. The switch circuit 5 in the circuits of FIGS. 1, 2 and 3 may have a similar structure as that of this switch circuit 7 shown in FIG. 6.

Descriptions have been provided four-channel stereo receivers which carry out the four-channel stereo indication and operate in the two-channel mode when the input is a two-channel composite signal and in the four-channel mode when the input is a four-channel composite signal. Now, FIG. 7 shows a system which performs muting when the input is a monaural or a two-channel signal. In FIG. 7, a switching circuit 5 of control circuits activated by the output of the third sub-channel signal detector circuit 4 is connected between the demodulator 1 and the input terminal *a*. Thus, when a four-channel composite signal is applied to the input terminal *a*, it is applied to the demodulator 1 through the switch circuit 5 to provide four audio signals at the output terminals *b*, *c*, *d*, and *e*, but when a two-channel composite signal is applied to the input terminal *a*, it is cut off by the switch circuit 5 so that the input signal does not reach the demodulator circuit 1 and thereby no audio signal output is provided at the output terminals *b*, *c*, *d*, and *e*. Namely, the system mutes off the audio signal at the output terminals *b*, *c*, *d*, and *e* when a monaural or two-channel signal is applied. Concrete examples of the third sub-channel signal detector circuit 4 and the switch circuit 5 used in the system of FIG. 7 are shown in FIG. 8. In the third sub-channel signal detector 4, the third sub-channel signal is derived from the composite signal applied to the base of a transistor 30, using the tuning by a coil 29 and a capacitor 28 and converted into a dc signal through a diode 32. The switch circuit 5 has a similar structure to that of the switching circuit shown in FIG. 6 except the point that a transistor 36 is additively connected. The transistor 36 becomes open when a four-channel composite signal is received. Then, the input signal is applied to the demodulator circuit 1. When a monaural or a two-channel composite signal is received, the transistor becomes short-circuited to cut off the input signal thereat.

Next, description will be made of a muting circuit as shown in FIG. 9. FIG. 9 shows a circuit in which switching circuits 38, 39, 40, and 41 of control circuits are provided on the output side of the demodulator circuit 1 in place of the switch circuit 5 in FIG. 7. When a four-channel composite signal is applied, the switch circuits 38 to 41 are activated to provide four separated signals at output terminals *b'*, *c'*, *d'*, and *e'*, whereas when a two-channel or a monaural signal having no third sub-channel signal is applied, the switch circuits 38 to 41 are turned off by the output of the third sub-channel signal detector 4 and hence no audio signal output appears at the output terminals *b'*, *c'*, *d'*, and *e'*. Muting operation is thus achieved.

In the above embodiments, the third subchannel signal contained in the four-channel composite signal is used for changing over the four-channel operation and the monaural and two-channel operation. Next, description will be made of embodiments in which the operational state is changed over by the presence or absence of the second sub-channel signal, in connection with FIGS. 10, 11, and 12.

In the above description, the four-channel composite signal was assumed to be represented by equation (2), but there is also another four-channel composite signal represented as $$M(t) = A + B \sin \omega t + C \cos \omega t + P_1 \sin \tfrac{1}{2} wt \qquad (10).$$

The frequency spectrum of equation (10) is shown in FIG. 13. In equation (10), there is no third subchannel signal and the difference from the two-channel represented by equation (1) lies in the existence of the second sub-channel signal represented by the third term in the right side. Here, the case is considered in which $$A = (L_1 + L_2 + R_1 + R_2) \quad (11),$$

$$B = (L_1 + L_2 - R_1 - R_2) \quad (12), \text{ and}$$

$$C = (L_1 + R_1 - R_2 - L_2) \quad (13).$$

In FIG. 10, the four channel signal of equation (10) is applied to two switching circuits 1*a* and 1*d*. of demodulator 1. The first switching signal (38 KHz) is derived from a first switching signal generator circuit 3 and is applied to the switching circuit 1*a* to perform switching. Then, the signal is separated into $$(L_1 + L_2) + \quad (14) \text{ and}$$

$$(R_1 + R_2) + \quad (15).$$

A third switching signal generator circuit 11 generates a third switching signal having a phase 90° shifted from that of the first switching signal. The third switching signal is applied to the switching circuit 1*d* to perform switching. Then, the signal is separated into the front and the rear signal, $$(L_1 + R_1) + \quad (16) \text{ and}$$

$$(L_2 + R_2) + \quad (17).$$

These signals are supplied to a matrix circuit 10 to produce four signals the low frequency components of which are represented by $$(L_1 + L_2) + (L_1 + R_1) = 2L_1 + R_1 + L_2 \quad (18),$$

$$(L_1 + L_2) + (L_2 + R_2) = 2L_2 + L_1 + R_2 \quad (19),$$

$$(R_1 + R_2) + (L_1 + R_1) = 2R_1 + L_1 + R_2 \quad (20), \text{ and}$$

$$(R_1 + R_2) + (L_2 + R_2) = 2R_1 + L_2 \quad (21).$$

The signal represented by equation (18), for example, has a larger magnitude in one direction as shown in FIG. 14. Thus, separation of the composite signal can be done to a certain degree. The signal represented by equation (18) is reproduced to sound from four loud speakers as is shown in FIG. 14.

The composite signal applied to the input terminal a is, on one hand, applied to a second sub-channel signal detector circuit 42 to take out the signal in the second sub-channel band by a filter. The third switching signal (equal to the second sub-carrier wave) derived from the third switching signal generator 11 is added to said signal in the second sub-channel band to demodulte the latter and derive the audio frequency signal. The audio frequency signal is rectified into a dc signal. This dc signal on-off controls a switch circuit 43 of control circuits to turn on an indicator lamp 8 when the input is a four-channel signal. Further, in the case of a four-channel signal input, the dc output signal of the second sub-channel signal detector 42 is applied to the switching circuit 1*a* and 1*d* to allow both of them to operate. In the case of a two-channel signal input, if the output of the second sub-channel signal detector 42 is arranged to turn off the switching circuit 1*d*, the left and right signal L and R appear at the output terminals *b* to *e* so as to achieve the automatic changeover of the two- and the four-channel operation, whereas if the output of the second sub-channel signal detector 42 is arranged to turn off both of the switching circuits 1*a* and 1*d*, no audio signal output appears at the output terminals *b* to *e*, thereby achieving the muting operation (a monaural signal is also muted in this case because of the absence of the second sub-channel signal).

FIG. 11 shows a system in which the second subchannel signal is used for achieving the desired operations even when the four-channel composite signal represented by equation (2) (not equation (10)) is applied. In FIG. 11, a demodulator circuit 1 similar to that in FIG. 1 is used but the difference lies in the use of a second sub-channel signal detector circuit 42 in place of the third sub-channel signal detector 4 in FIG. 1. For demodulating the audio frequency signal in said second sub-channel signal detector 42 as is the case in the embodiment of FIG. 10, the third switching signal (a signal similar to the second carrier wave having a frequency of 38 KHz) is formed in a third switching signal generator 11 and is applied to the second sub-channel signal detector 42. Then, the four-channel indication is done in a similar manner to that in FIG. 10. The dc output signal of the second sub-channel detector 42 activates switching circuits 1*b* and 1*c* of demodulator 1 when the input is a four-channel signal and when it is a two-channel signal, cuts off the switching signal applied to the switching circuits 1*b* and 1*c* to allow the direct transmission of the output of a switching circuit is through the switching circuits 1*b* and 1*c* of demodulator 1 and the control circuits therefor. In the latter case, the left and the right signals L and R appear at terminals b to e. Thus, automatic change-over of the four- and the two-channel operation can be achieved. If it is arranged that under the two-channel signal input the switching circuits 1*b* and 1*c* are cut off so as to generate no output at the output terminals *b* to *e*, the muting operation is achieved and the audio output appears only when a four-channel signal is put in (a monaural signal as well as a two-channel signal is muted).

FIG. 12 shows another embodiment in which a switch circuit 45 of control circuits activated by the dc output signal of the second sub-channel signal detector 42 is provided on the output side of the demodulator circuit to derive the audio output signal at output terminal *b'* to *e'* only when a four-channel signal is put in.

Next, description will be made of embodiments in which demodulator circuits different from those described hereinabove are used, in connection with FIGS. 15, 16, 17, and 18.

Figure 15:
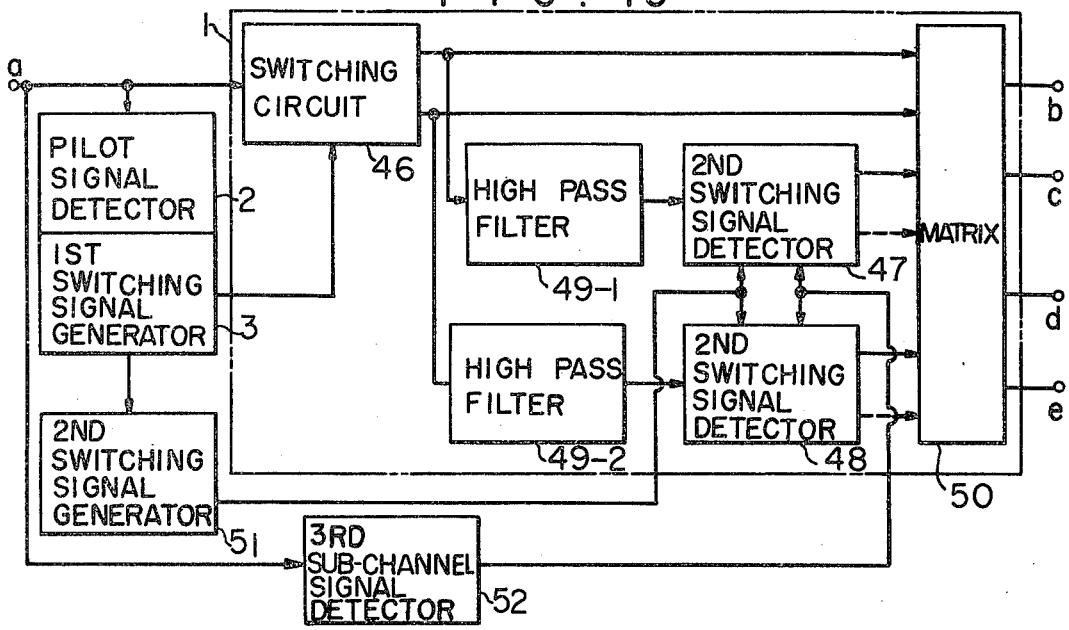

In FIG. 15, when a four-channel stereo conposite signal represented by equation (2) is applied to an input terminal *a*, it is applied to a switching circuit 46 in a demodulator circuit 1 on one hand and to a pilot signal detector circuit 2 on the other hand. A first switching signal (here a 38 KGz signal almost similar to the first sub-carrier wave) is formed in a first switching signal generator circuit 3 and applied to the switching circuit 46 to provide the low and high frequency signal components separated into right and left portions at the output terminals of the switching circuit 46. Partial examples of these outputs are $$(L_1 + L_2) + (L_1 - L_2) \sin 2\omega t + (L_1 - L_2) \cos \omega t + \quad (22), \text{ and}$$

$$(R_1 + R_2) + (R_1 - R_2) \sin 2\omega t + (R_1 - R_2) \cos \omega t + \quad (23).$$

These outputs are supplied both to a matrix circuit 50 and to detectors 47 and 47 through high-pass filters 49-1 and 49-2. The first switching signal is generated from the first switching signal generator 3 and applied also to a second switching signal generator 51 to generate the second switching signal. In this second switching signal generator 51, a 76 KHz signal similar to the third sub-carrier wave or a 38 KGz signal similar to the second sub-carrier wave but having a phase 90° shifted from that of the first switching signal is formed. The second switching signal is applied to and detected in the detector circuits 47 and 48. When the outputs of the switching circuit 46 have passed through the high-pass filters 49-1 and 49-2, the signal represented by equation (22) becomes $$(L_1 - L_2) \sin 2\,\omega t + (L_1 - L_2) \cos \omega t + \quad (24),$$

and the signal represented by equation (23) becomes $$(R_1 - R_2) \sin 2\,\omega t + (R_1 - R_2) \cos \omega t + \quad (25).$$

Here, the high-pass filters 49-1 and 49-2 allow frequency components higher than the frequency of the first and the second sub-channel signal. When these signals are applied to and detected in the detectors 47 and 48, output signals of $(L_1 - L_2)$ and $(R_1 - R_2)$ apear at the output terminals of the detectors 47 and 48 in both cases where the second switching signal is similar to the third sub-carrier wave and where it is similar to the second sub-carrier wave (but the phases of said outputs may differ by 180°). The outputs of these detectors 47 and 48 are applied to a matrix circuit 50 together with the output of the switching circuit 46. Low-frequency signals derived through low-pass filters become $$(L_1 + L_2) + (L_1 - L_2) = 2L_1 \quad (26),$$

$$(L_1 + L_2) - (L_1 - L_2) = 2L_2 \quad (27),$$

$$(R_1 + R_2) + (R_1 - R_2) = 2R_1 \quad (28), \text{ and}$$

$$(R_1 + R_2) - (R_1 + R_2) = 2R_2 \quad (29),$$

And thus separated into four signals. Further, if two output terminals are provided to each of the detectors 47 and 48 to derive signals of the opposite phase the operation needed in the matrix circuit may become only addition.

Automatic change-over of the operation according to whether the input is a four- or a two-channel signal can be done by switching on and off the operation of the detectors 47 and 48. Namely, the second switching signal applied to the detectors 47 and 48 may be removed to stop the operation of the detectors, or the operation of the detectors may be stopped, or alternatively connection between the inputs and the outputs of the detectors 47 and 48 may be cut off. For this purpose, the second or third sub-channel signal may be detected and converted into a dc signal in the second and third sub-channel signal detector 52 to on-off control the detectors 47 and 48 therewith, i.e. activate the detectors 47 and 48 under a four-channel signal input and stop the operation of the detectors 47 and 48 under a two-channel or a monaural signal input. In this way, automatic change-over can be accomplished easily. As to the operation of this third sub-channel signal detector, there are two ways; one by providing a filter for passing only the third sub-channel signal and rectifying the output of this filter, and one by adding the third sub-carrier wave to only the third sub-channel signal, detecting the audio frequency signal therefrom and rectifying it into a dc signal. Further, since the second sub-channel signal has the same frequency as but a different phase from that of the first sub-channel signal, a method can also be employed in which the second sub-carrier wave is added to the second sub-channel signal and the audio frequency signal is detected and rectified from the sum signal to generate a dc signal.

Figure 16:
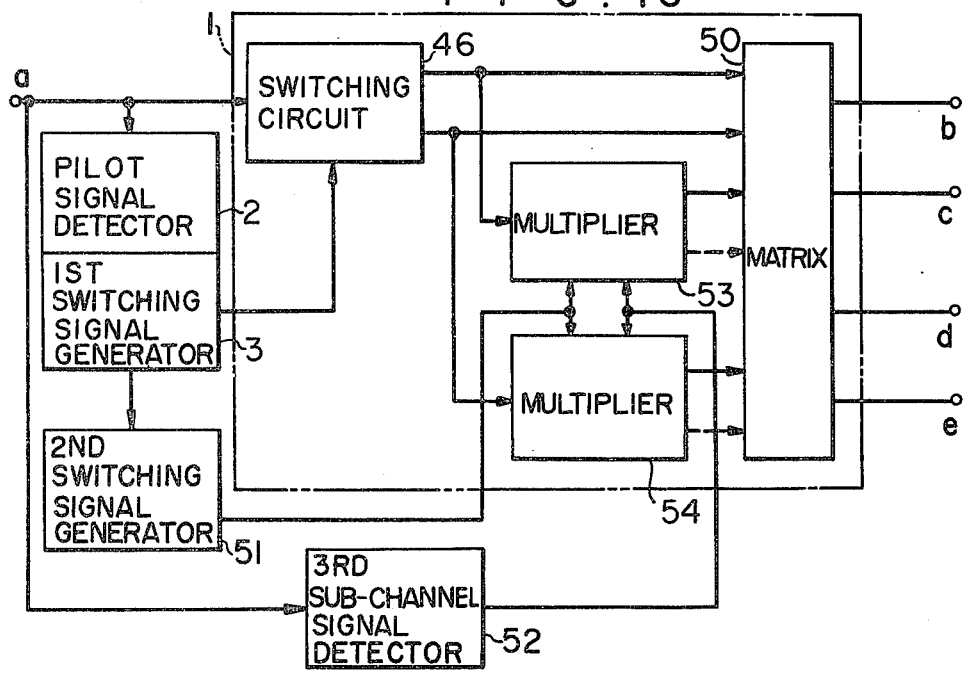

FIG. 16 shows another embodiment which can operate without the use of high-pass filters as indicated by 49-1 and 49-2 in FIG. 15. In FIG. 16, multiplier circuits 53 and 54 are provided in place of the detectors 47 and 48 of FIG. 15. The outputs of the switching circuit 46 represented by equations (24) and (25) are supplied to multiplier circuits 53 and 54 and also the second switching signal is supplied to the multipliers 53 and 54 to achieve multiplication. Then, the signal represented by equation (24) becomes $$(L_1 - L_2) + \quad (30),$$

and the signal represented by equation (25) becomes $$(R_1 - R_2) + \quad (31).$$

When these signals are allowed to pass through low pass filters, they become $(L_1 - L_2)$ and $(R_1 - R_2)$. Thus, signals similar to those provided in the embodiment of FIG. 15 can be provided.

FIGS. 17 and 18 show other embodiments which perform similar operations as those of the embodiments of FIGS. 15 and 16, respectively, by providing similar switching circuits 46 and 46' in place of the circuit 46 in FIGS. 15 and 16, and detecting the output signal of the switching circuit 46' or multiplying it by the second switching signal in the detectors 47 and 48 or in the multipliers 53 and 54, respectively. An example of the multiplier used in the embodiments of FIGS. 16 and 18 is shown in FIG. 19. In this figure, numerals 58, 59, 66, 67, 68, and 69 denote transistors, 56, 60, 62, 64, 65, 70, and 71 resistors, 55 an impedance, and 61 and 63 capacitors. The output of the switching circuit 46 is applied to a terminal 57, the second switching signal is applied to a terminal 74, and output signals are derived from terminals 72 and 73. Further, when the audio output is desired to be muted except the case of a four-channel signal reception, the switching circuit 46 may be controlled by the output of the second and third sub-channel signal detector 52 so as to generate no audio signal output at the output terminals in the case of a monaural or a two-channel signal reception.

The four-channel stereo composite signal described hereinabove was one represented by equation (2) or one represented by equation (10). There are further types of the four-channel stereo composite signal including further a second pilot signal in addition to said components. Such signals are represented by $$M(t) = A + B \sin \omega t + C \cos \omega t + D \sin 2\,\omega t + P_1 \sin \tfrac{1}{2}\,\omega t + Q \quad (32), \text{ and}$$

$$M(t) = A + B \sin \omega t + C \cos \omega t + P_1 \sin \omega t + Q \quad (33),$$

where Q represents the second pilot signal which may take the form of $P_2 \sin 3/2\,\omega t$, $P_2 \sin 2\,\omega t$, $P_2 \sin 5/2\,\omega t$, etc. Here, the fourth term in equation (32) may have a single side band similar to the case of equation (2). Thus, the frequency spectrum of equation (32) include $P_2 \sin 3/2\,\omega t$ (57 KHz), $P_2 \sin 2\,\omega t$ (76 KHz), $P_2 \sin 5/2\,\omega t$ (95 KHz), etc. in addition to the spectra shown in FIGS. 5a, 5b and 5c. Similarly, the frequency spectrum of equation (33) is one including $P_2 \sin 3/2\,\omega t$, $P_2 \sin 2$ $\omega t$, $P_2$ sin 5/2 $\omega t$, etc. as the second pilot signal Q in addition to the spectrum shown in FIG. 13.

Description will now be made of embodiments in which the change-over of the operation is done by the use of the second pilot signal in the composite signal of equation (32) or (33).

Figure 20:
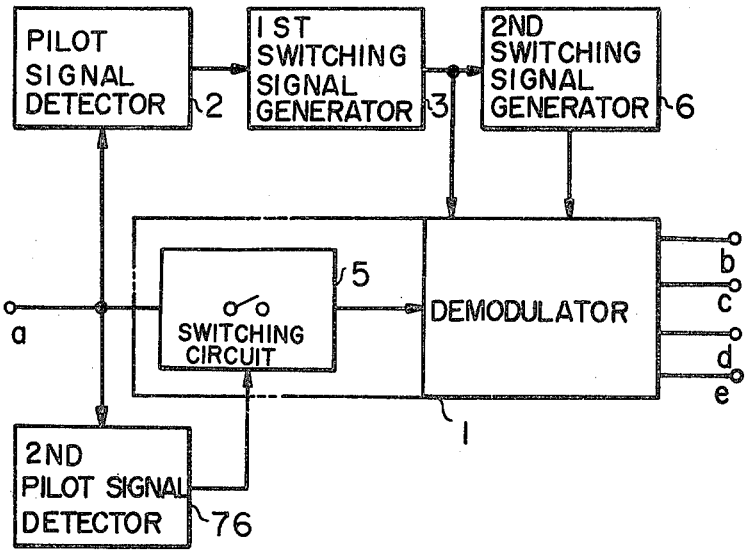

FIG. 20 shows an embodiment in which the composite signal received at the terminal *a* is applied to a switch circuit 5 of control circuits, a first pilot signal detector 2, and a second pilot signal detector 76. The output of the first pilot signal detector 2 is applied to a first switching signal generator 3 to generate the first switching signal and the output of the latter is then applied to a second switching signal generator 6 to generate the second switching signal. The first and the second switching signals are applied to a demodulator circuit 1. The second pilot signal is detected and converted into a dc signal in the second pilot signal detector 76. This dc signal turns on the switching circuit 5. Then, the composite signal is applied to the demodulator circuit 1 to provide four signals at output terminals *b*, *c*, *d*, and *e*.

When the input signal is a monaural or a two-channel signal including no second pilot signal, the switching circuit 5 becomes off and the composite signal is not applied to the demodulator circuit 1. Therefore, no audio signal output appears at the output terminals *b*, *c*, *d*, and *e*, i.e. the signal is muted. Thus, selective reception of only the four-channel broadcasting having the second pilot signal can be obtained.

Figure 21:
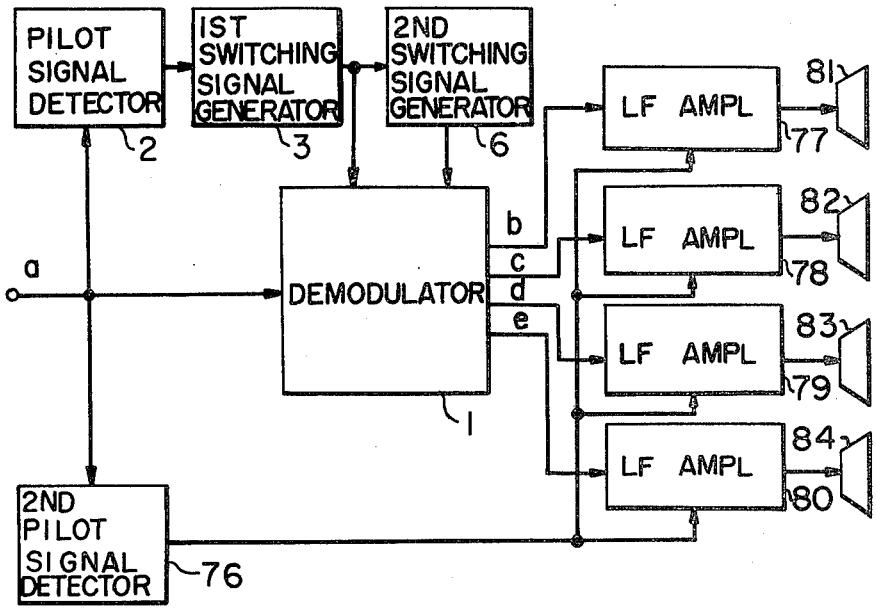

FIG. 21 shows another embodiment, in which low frequency (l.f.) amplifiers 77, 78, 79, and 80 are provided on the output side of the demodulator circuit 1 and on-off controlled by the output of the second pilot signal detector circuit 76. Thus, only when a four-channel signal is put in, the low frequency amplifiers become operative and loud speakers 81, 82, 83, and 84 give outputs, whereas when a monaural or a two-channel signal is put in, it cannot be transmitted to the loud speakers 81, 82, 83, and 84. Further, in the embodiments of FIGS. 20 and 21, on-off control by the output of the second pilot signal detector is done after or before the demodulation, but it can be done in the demodulation circuit 1.

Figure 22:
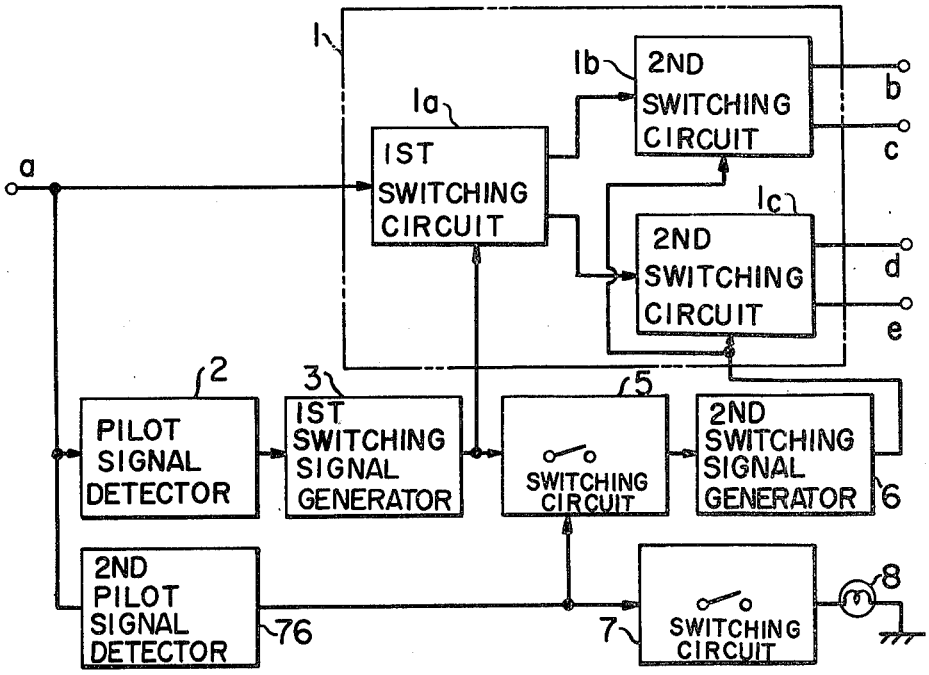

FIG. 22 shows another embodiment in which the third sub-channel detector circuit in the embodiment of FIG. 1 is replaced with a second pilot signal detector circuit 76. When a four-channel signal is put in, the switch circuits 5 and 7 of the control circuits are turned on by the output of the second pilot signal detector circuit 76, thereby turning on the indicator lamp 8 and applying the second switching signal to the second switching circuits 1b and 1c of demodulator 1. When a two-channel signal is received, the switching circuits 5 and 7 are turned off, thereby turning off the second switching signal and the indicator lamp 8.

Figure 23:
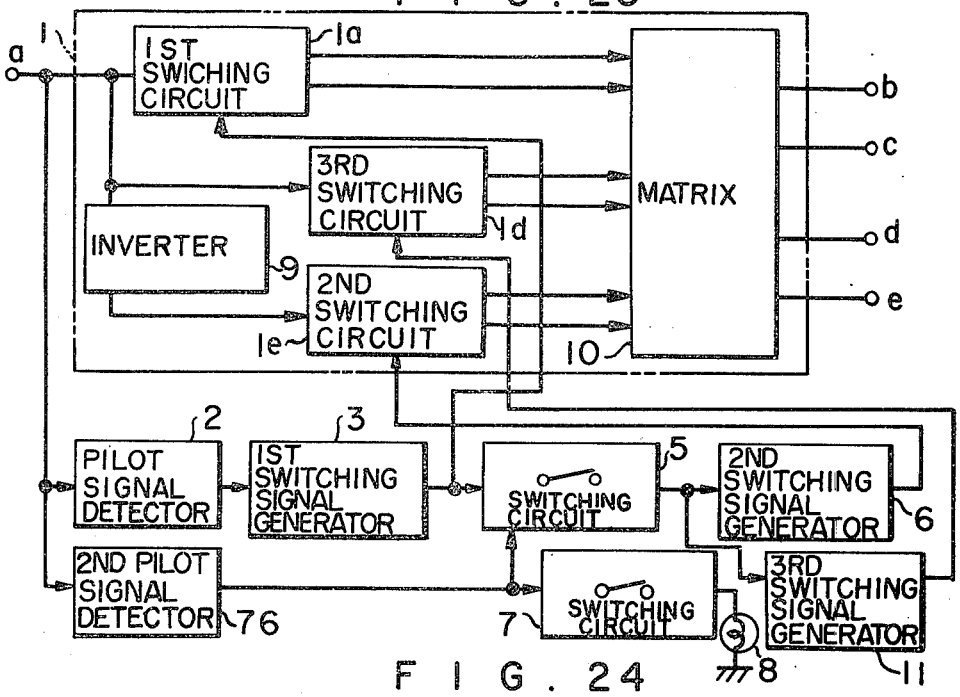

FIG. 23 shows an embodiment in which a second pilot signal detector circuit 76 is provided in place of the third sub-channel signal detector circuit 4 in the embodiment of FIG. 2. When a four-channel signal is received, the switch circuits 5 and 7 of the control circuits are turned on to turn on the indicator lamp 8, and the second and the third switching signals (signals having a frequency equal to the second and the third sub-carrier wave frequencies) are applied to the second and the third switching circuit 1e and 1d of demodulator 1. When a two-channel signal is received, the switch circuits 5 and 7 are turned off to cut off the indicator lamp 8 and the second and the third switching signal.

Figure 24:
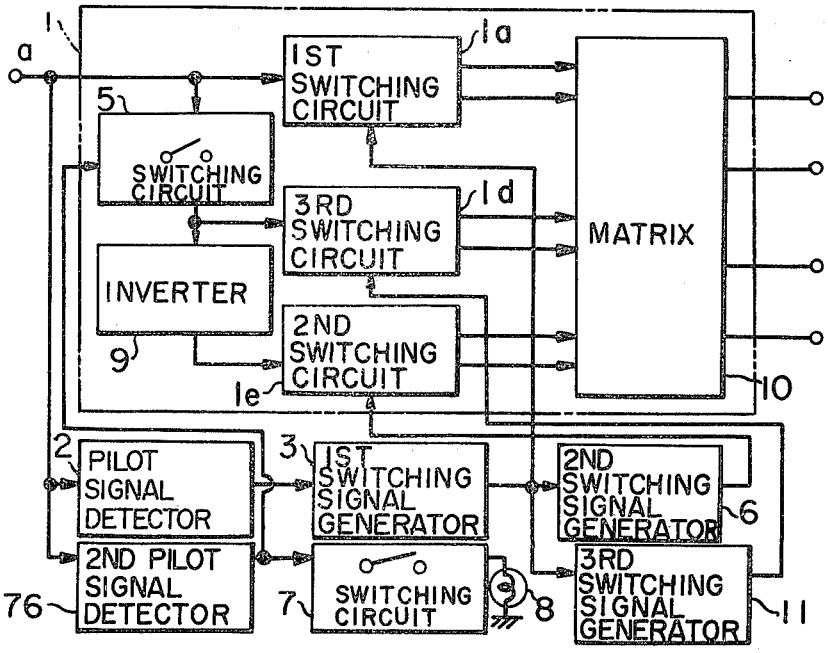

FIG. 24 shows another embodiment in which a second pilot signal detector circuit 76 is provided in place of the third sub-channel signal detector circuit 4 in the embodiment of FIG. 3. The switch circuit 5 of control circuits and the second pilot signal detector circuit 76 control the operation mode. When a four-channel signal is supplied, the composite signal is applied to the second and the third switching circuits 1e and 1d of demodulator 1, whereas when a two-channel signal is supplied, it is not applied to the switching circuits 1*e* and 1*d*.

Further, the embodiments of FIGS. 15, 16, 17, and 18 can be modified by providing a second pilot signal detector circuit 76 in place of the second and third sub-channel signal detector circuit 52 so that the circuits 47 and 48, or 53 and 54 become operative when a four-channel signal is supplied, but become cut off when a two-channel signal is supplied.

In the above embodiments, the second or the third sub-channel signal or the second pilot signal was used for changing over the four-channel operation mode. There may occur inconveniences, however, if only these signals are used. Namely, mis-operation may occur by noises when no signal is supplied to the receiver or it may arise from the time constant circuit for keeping the on-state for a certain time period as described in connection with FIG. 6. For removing these possibilities, two-channel signal components, signals in the intermediate frequency (i.f.) amplifier of the tuner, or noises in the tuner as well as said signals may be used.

Figure 25:
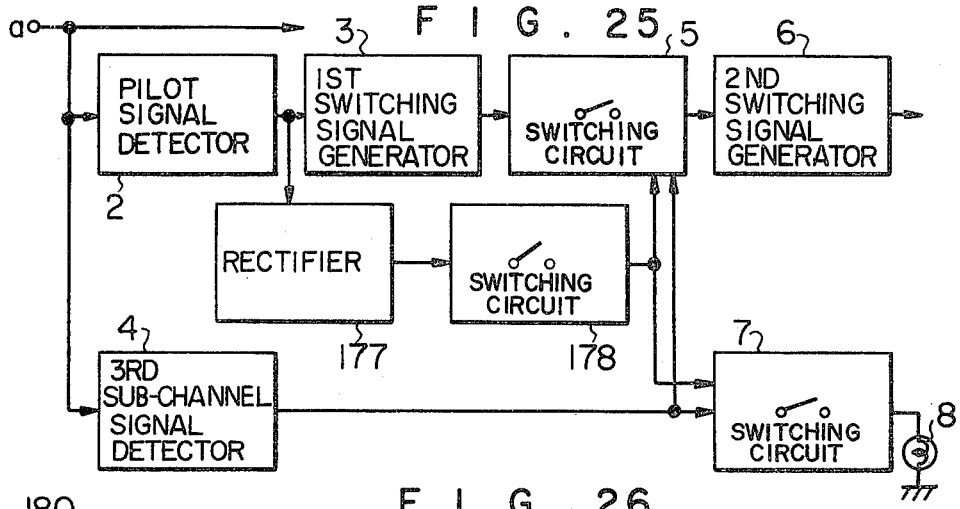

FIG. 25 shows an embodiment in which the output signal of the third sub-channel signal detector circuit 4 in the circuit of FIG. 1 is controlled by the existence of the first pilot signal. Namely, the signal of the first pilot signal detector 2 is rectified in a rectifier circuit 177 to provide a dc signal which then on-off controls the switch circuit 178 of the control circuits. When the input signal includes the first pilot signal, the switching circuit is made open. If the input signal is a four-channel signal having the third sub-channel signal, an output appears at the third sub-channel signal detector circuit 4 to turn on the switch circuits 5 and 7 of the control circuits and indicate the four-channel operation by the indicator 8. When tuning is shifted in the receiver circuit having the switching circuit as shown in FIG. 6, the switching circuit keeps the on-state for a certain period (for example 30 seconds) even after the third sub-channel signal has disappeared. Thus, an arrangement may be provided to erase the first pilot signal and short-circuit the switch circuit 178, and hence turn off the switch circuits 5 and 7 when tuning is shifted. Then, as soon as the tuning is shifted, the four-channel mode indication can be turned off and the four-channel mode operation can be cut off. The circuit of FIG. 25 can be applied to the circuits of FIGS. 2, 3, 6, 7, 8, and 9 as well as that of FIG. 1 so that the switch circuits activated by the output of the third sub-channel signal detector 4 becomes non-operative as soon as the first pilot signal disappears. Then, the automatic change-over between the two-channel and the four-channel operations or the muting of the monaural and the two-channel signal can be accomplished. Similar effects can be obtained by on-off controlling the switching circuits activated by the second sub-channel signal detector 42 in the circuits of FIGS. 10, 11, and 12 with the switch circuit 178 activated by the presence or absence of the first pilot signal, or by controlling the switching circuits activated by the second and third sub-channel signal detector 52 and the second pilot signal detector 76 in the circuits of FIGS. 15 to 24 with the switch circuit 178.

Figure 26:
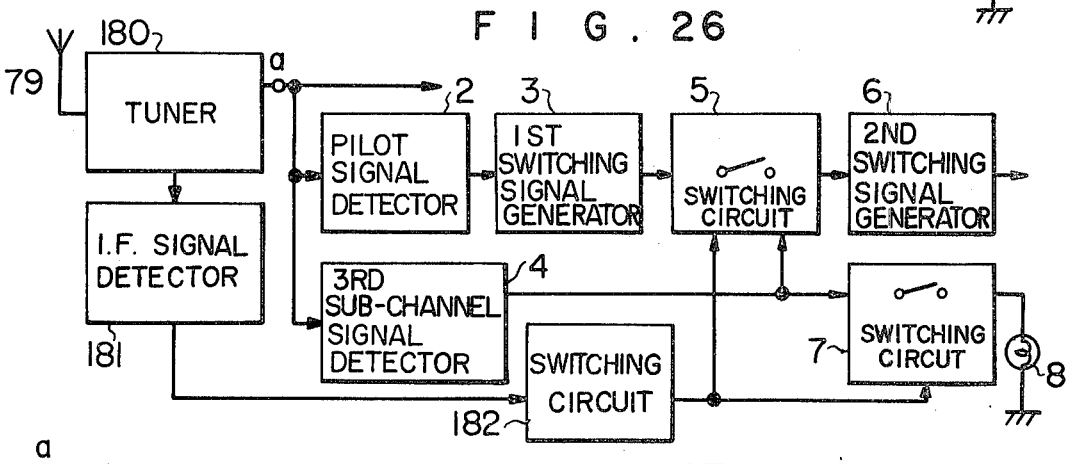

FIG. 26 shows another embodiment in which a switch circuit 182 of the control circuits on-off controlled by the presence or absence of the signal from the i.f amplifier in the tuner is used in place of the switch circuit 178 on-off controlled by the presence or absence of the first pilot signal. The circuit of FIG. 26 is similar to the circuit of FIG. 1 except the addition of a tuner 180, and an i.f. signal detector 181 for deriving signal from the tuner. When tuning is carried out and a four-channel signal is received through an antenna 179, the switch circuits 5 and 7 of the control circuits are turned on as described in connection with FIG. 1. Here, the signal includes an i.f. component and thus a dc signal appears at the output of the i.f. signal detector 181 to open the switch circuit 182 and leave the switch circuits 5 and 7 closed. When the tuning of the tuner is shifted, the i.f. signal disappears, hence the switching circuit 182 is short-circuited and the switching circuits 5 and 7 are immediately turned off.

In the circuits of FIGS. 1 to 24, the switch circuits 5, 7, 38–41, 43 and 45 may be activated by the second and the third sub-channel signal detectors 4, 42, and the second and third sub-channel signal detector 52 and the second pilot signal detector 76 may be replaced with the switch circuit 182 shown in FIG. 26. Then, the four-channel indication and the four-channel mode operation can be changed over easily and swiftly.

Figure 27:
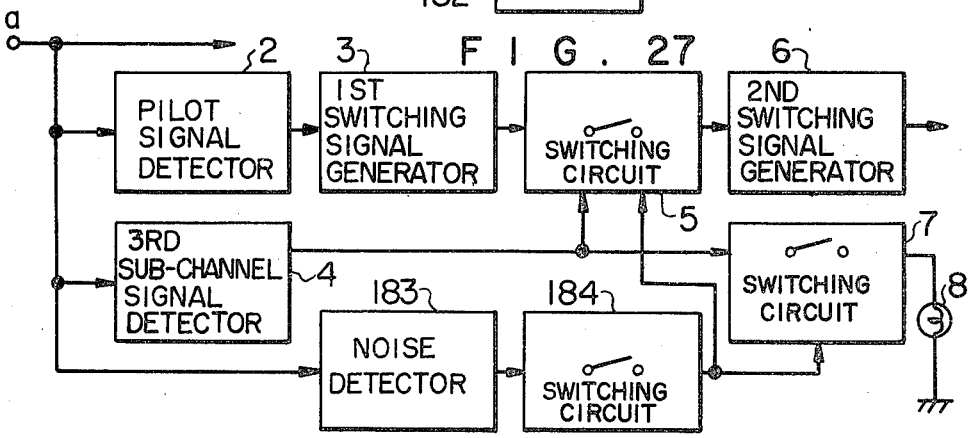

FIG. 27 shows another embodiment in which a noise detector 183 is provided for the detected tuner output. When tuning is carried out and a four-channel signal is received, the switch circuit 184 is left open so that the circuit operates in a similar manner to that of the circuits of FIGS. 1 to 24. When tuning is shifted, noises grow large in the detected tuner output and a dc signal appears in the output of the noise detector 183 to short-circuit the switch circuit 184. Then, the switch circuits 5 and 7 of the control circuits activated by the detector 4 (equivalent to the detectors 4, 42, 52 and 76 in the circuits of FIGS. 1 to 24) are turned off so as to immediately turn off the indicator 8 and the four-channel operation.

Figure 28:
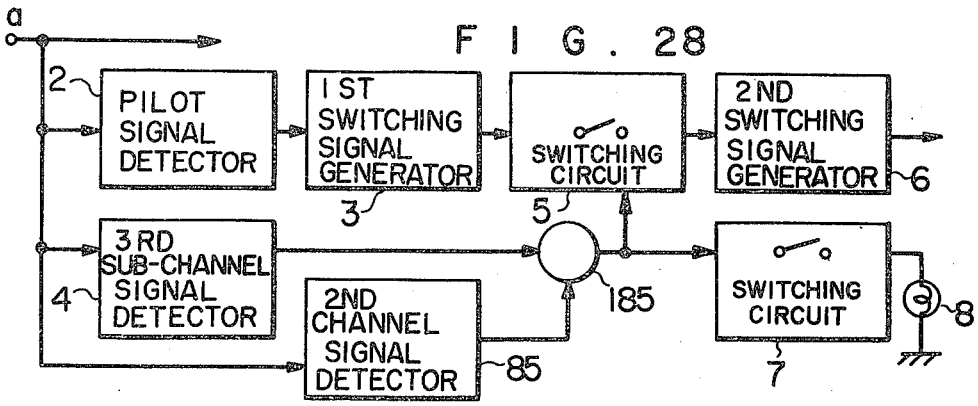

FIG. 28 shows another embodiment in which a two-channel signal detector circuit 85 is provided. In tuning with a tuner, the input signal is usually distorted and the harmonic of the sub-channel signal in the two-channel signal lies in the frequency band similar to that of the third sub-channel signal of the four-channel signal. Thus, in such circuits activated by the third sub-channel signal as that of FIG. 1, a dc signal may appear in the third sub-channel signal detector 4 even when a two-channel signal is received. This becomes a cause of mis-operation. Therefore, in the circuit of FIG. 28, there are provided a two-channel signal detector 85 for detecting at least one of the main channel signal, the pilot signal and the sub-channel signal of the two-channel composite signal, and a comparator circuit 185 for comparing the outputs of the two-channel signal detector 85 and the third sub-channel signal detector 4. This comparator circuit 185 turns off the switch circuits 5 and 7 of the control circuits when the output of the two-channel signal detector 85 is larger (i.e. when a two-channel signal is received). Mis-operation is thus prevented. This circuit is effective in the case of using the third or the second sub-channel signal detector 4, 42, and 52 in the circuits of FIGS. 1 to 18.

Further, in case of discriminating whether the received signal is a four-channel or a two-channel signal, operating a four-channel indicator, and automatically changing over the four-channel and the two-channel mode operation or muting the monaural and the two-channel signal, if tuning was not well done, distortion may arise in f.m. detection and the harmonic of the first sub-channel signal component for a two-channel signal may arise in the third sub-channel signal region. Further, in such a case, the phase relation between the pilot signal and the first subchannel signal may be disturbed and a dc output may be generated in the second and the third sub-channel signal detector. Thus, the four-channel operation may be done even when a two-channel signal is received. Some means for preventing such a mis-operation are shown in FIGS. 29 and 30.

Figure 29:
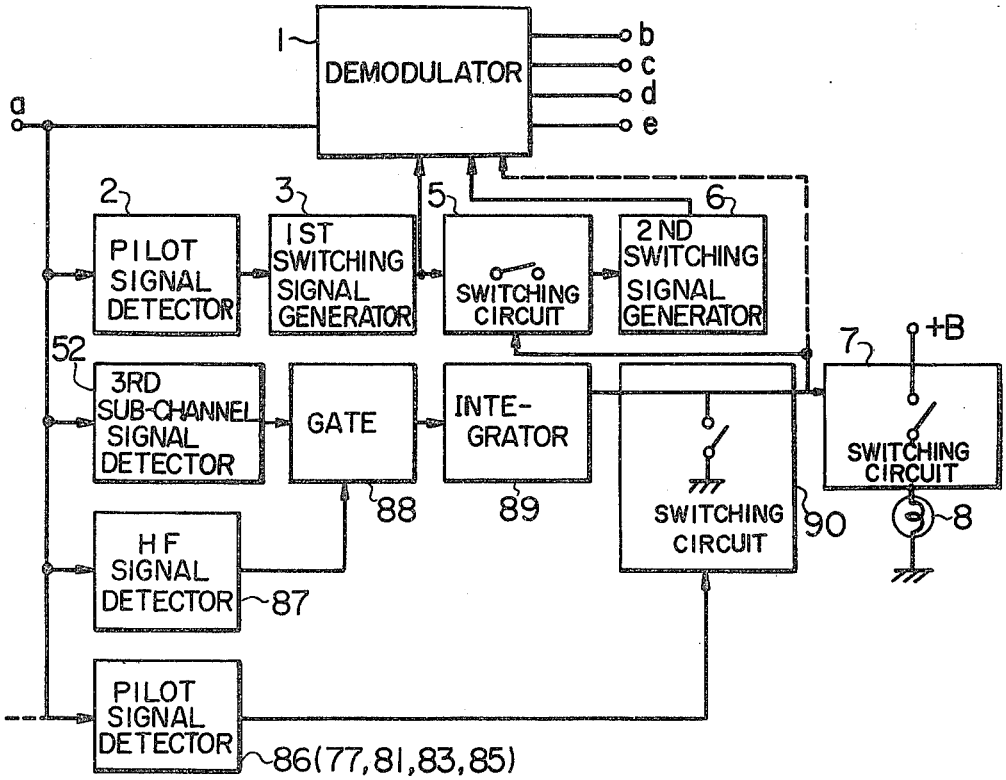
Figure 30:
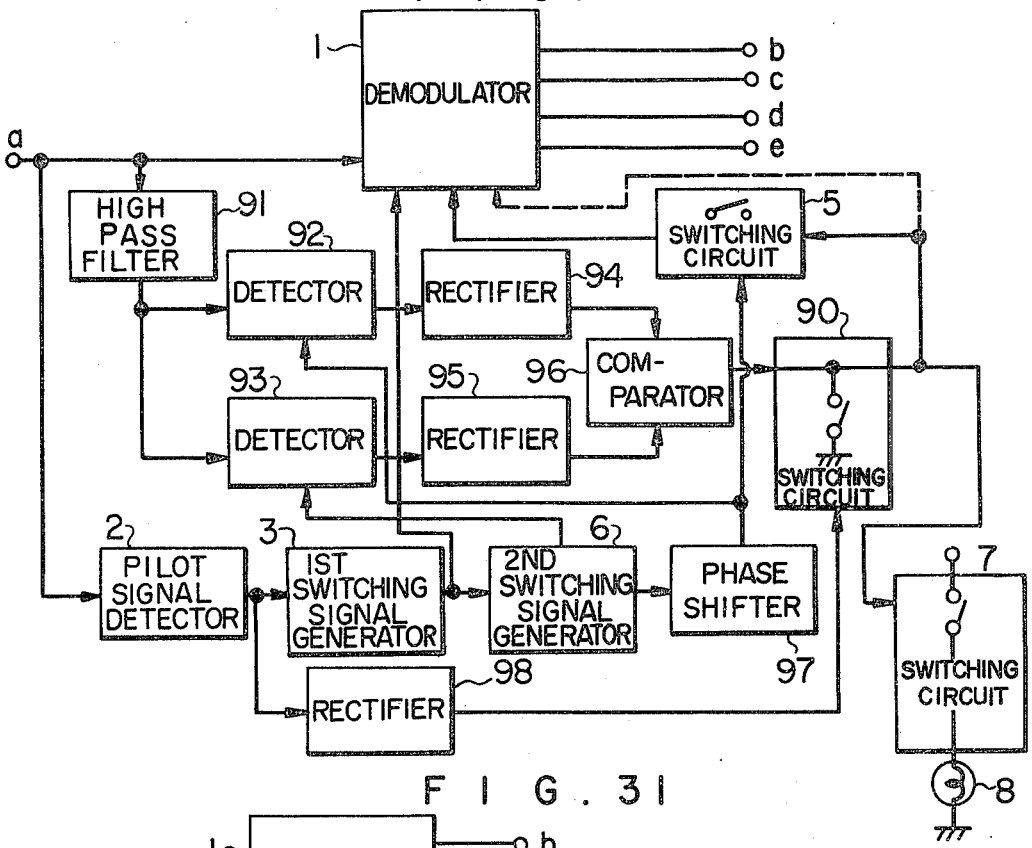

In FIG. 29, the composite signal represented by equation (2) and received at the input terminal is applied to a demodulator 1, a pilot signal detector 2, a second and third sub-channel signal detector 52, a h.f. signal detector 87, and another pilot signal detector 86. A dc signal derived from the second and third sub-channel signal detector 52 is applied to a gate circuit 88, while the h.f. component of the first sub-channel component is derived and rectified into a dc signal in the h.f. signal detector 87. When this dc signal exceeds a certain level, it turns off the gate 88. Namely, the h.f. component of the first sub-channel is large, the gate circuit 88 is turned off and prevent the output signal of the second and third sub-channel signal detector from reaching an integrator 89. Thus, the switch circuits 5 and 7 are turned off. When the h.f. component of the first sub-channel signal is small, the gate circuit 88 becomes conductive and allows the output signal of the circuit 52 to go through the integrator 89 to the switch circuits 5 and 7 to turn on them and hence turn on the indicator lamp 8. Further, the demodulator circuit 1 is also carried into the operative state. When the two- and the four-channel mode operations are to be automatically changed over, the second switching signal is on-off controlled in the switching circuit 5, and when the monaural and the two-channel signals are to be muted, the demodulator circuit 1 is on-off controlled by the output of a switching circuit 90. The switching circuit 90 is on-off controlled by the dc output of the pilot signal detector 86 and is open when the circuit is tuned to a four-channel or a two-channel signal. The pilot signal detector 86 may be replaced with a noise detector or an i.f. detector. The h.f. signal detector preferably detects the second — third and fourth harmonics of the 38 KHz signal.

When distortion arises in a two-channel composite signal, a signal component is generated in the portion orthogonal to the third sub-channel. FIG. 30 shows an embodiment utilizing the above fact, in which a signal component orthogonal to the third subchannel is detected and used for preventing mis-operation. In the figure, when a composite signal $M(t)$ represented by equation (2) is supplied to the input terminal $a$, it is applied to the demodulator circuit 1 for generating four signal outputs at the output terminals $b$, $c$, $d$, and $e$, and also to a high-pass filter 91 for removing the main channel component and to a pilot signal detector 2. The first switching signal ($\sin\omega t$) is derived in a first switching signal generating circuit 3 by the use of the pilot signal obtained from the pilot signal detector 2. The second switching signal (sin 2 $\omega t$) is derived in a second switching signal generating circuit 6 and a signal orthogonal to the second switching signal, i.e., cos 2 $\omega t$, is derived from a phase shifter 97. From the switching signal generating circuits 3 and 6, the signals of sin $\omega t$ and sin 2 $\omega t$ are applied to the demodulator circuit 1. On the other hand, a composite signal N ($t$) subjected to the subtraction of the main channel signal in the high-pass filter 91 is represented by $$N(t) = M(t) - A \qquad (34),$$

and is applied to detectors 92 and 93. The second switching signal sin 2 $\omega t$ is also applied to the detector 93 from the switching signal generator 6, and the orthogonal signal cos 2 $\omega t$ is also applied to the detector 92 from the phase shifter 97. Thus, the signal D in equation (2) is generated at the output of the detector 93 and no signal is generated at the output of the detector 92. When a two-channel signal is received, no output appears at the outputs of the detector circuits 92 and 93 since a two-channel signal has no third sub-channel signal. The outputs of the detectors 92 and 93 are sent to rectifiers 94 and 95 to be transformed into dc signals, respectively. The dc outputs of the rectifiers 94 and 95 are compared in a comparator 96. When the output of the rectifier 95 is larger than that of the rectifier 94, it is sent to the switching circuit 90. While a two-channel signal is received, no l.f. signal is derived from the detectors 92 and 93 and hence no output is generated from the comparator 96. Further, when distortion is caused in a two-channel signal, l.f. signals are derived from the both detectors 92 and 93. If the levels of the rectifiers 94 and 95 have been set in such a manner that the output of the detector 92 becomes larger than that of the detector 93 when signals of the same magnitude are applied, no output appears at the output of the comparator 96. Thus, only when a four-channel signal is received, the dc output of the rectifier 95 is supplied from the output of the comparator 96 and turns on the switching circuits 5 and 7 to activate the four-channel operation and the indicator lamp 8. Namely, for automatically changing over the two- and the four-channel operation, the switching circuit 5 is on-off controlled to on-off control the switching carrier, and for muting the monaural and the two-channel signals the demodulator circuit 1 is on-off controlled by the output of the switching circuit 90. Namely, the output signal of the pilot signal detector 2 is rectified into a dc signal in the rectifier 98. If the input signal includes the pilot signal, the dc signal opens the switching circuit 90. If the input signal includes no pilot signal and hence generates no output from the rectifier 98, the switching circuit 90 is shortcircuited to prevent the signal of the comparator 96 from being applied to the switching circuits 5 and 7.

Figure 31:
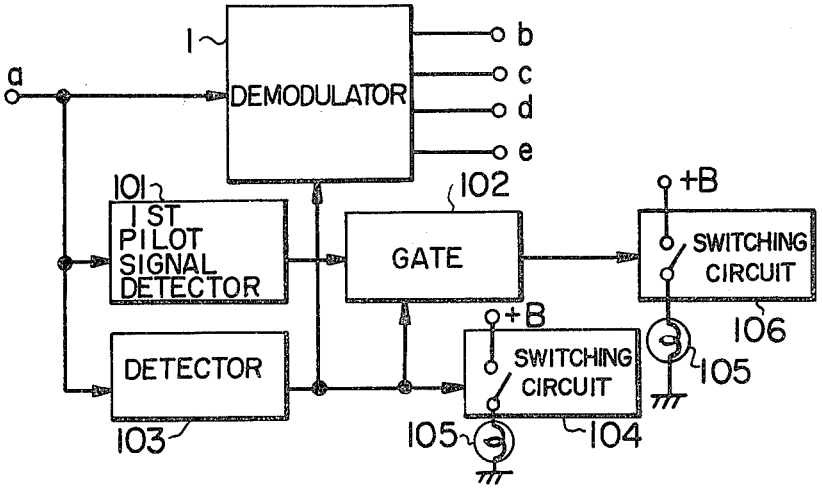

In the above embodiments, indication was done only for the four-channel mode operation. An explanation as to change-over of the four- and the two-channel indication will be made hereinbelow in connection with FIG. 31. In FIG. 31, the input terminal *a* is to be applied with a four-channel composite signal represented by equation (2), (10), (32), or (33), or a two-channel composite signal represented by equation (1). When the two-channel signal of equation (1) is received, the pilot signal is detected and rectified into a dc signal in a first pilot signal detector 101, then turns on a gate circuit 102 and then turns on a switching circuit 106 and a two-channel indicator 107. A detector circuit 103 detects at least one of the second sub-channel signal, the third sub-channel signal and the second pilot signal which are not included in the two-channel signal. When a two-channel signal is supplied to the detector 103, no output is generated therefrom. Thus, the gate circuit 102 is operated only by the output of the first pilot signal detector 101. When a fourchannel signal is received, however, at least one of the second and the third sub-channel signals and the second pilot signal is detected in the detector 103 and a dc signal is generated. When this dc signal exists, the gate circuit 102 is cut off even if the output of the circuit 101 exists. Therefore, the switching circuit 106 and the two-channel indicator 107 are turned off. On the other hand, the output of the detector 103 turns on the switching circuit 104 and a fourchannel indicator 105. Further, the demodulator circuit 1 is changed over to the four-channel operation by the output of the detector 103. As is described above, there are provided a four- and a two-channel indicators, the four-channel indicator is indicated only when a four-channel signal is received, and the two-channel indicator is indicated only when a twochannel signal is received. Further, as is described above, when a four-channel composite signal is received, a four-channel signal component not included in a two-channel composite signal is detected and used for automatically changing over the two-channel operation with the four-channel operation.

What is claimed is:

1. A four-channel stereo receiver for demodulating a four-channel signal consisting at least of a main channel signal component constituted by a first combination of the four signals, a first sub-channel signal component obtained through suppressed-carrier amplitude modulation of a second combination of said four signals, a second sub-channel signal obtained through suppressed-carrier amplitude modulation of a third combination of said four signals and being orthogonal to said first subchannel signal, and a third sub-channel signal obtained through suppressed-carrier amplitude modulation at a frequency twice as large as that of the first sub-carrier wave by a fourth combination of said four signals, and a pilot signal at a frequency equal to one-half that of said first sub-channel signal, comprising demodulating means comprising a first circuit supplied with said four-channel composite signal and switched by a first switching signal, a second circuit supplied with the output of said first circuit for performing detection by a second switching signal, said first and second switching signals being produced under control of said pilot signal, and a matrix means supplied with output signals from said first and second circuits and having outputs for providing four output signals.

2. A four-channel stereo receiver for demodulating a four-channel signal consisting at least of a main channel signal component constituted by a first combination of the four signals, the first sub-channel signal component obtained through suppresed-carrier amplitude modulation of a second combination of said four signals, the second sub-channel signal obtained through suppressed-carrier amplitude modulation of a third combination of said four signals and being orthogonal to said first sub-channel signal, and a third sub-channel signal obtained through suppressed-carrier amplitude modulation at a frequency twice as large as that of the first sub-carrier wave by a fourth combination of said four signals, and a pilot signal at a frequency equal to one-half that of said first sub-channel signal, comprising demodulating means comprising first, second and third switching circuits supplied with the four-channel composite signal, said first switching circuit being switched by a first switching signal at the first sub-carrier frequency, said second switching circuit by a second switching signal at the second sub-carrier frequency and said third switching circuit by a third switching signal at the third sub-carrier frequency, whereby an output signal of said first switching circuit is obtained from said main channel signal and first sub-channel signal, an output of said second switching circuit from said main channel signal and second subchannel signal, and an output signal of said third switching circuit from said main channel signal and third sub-channel signal, said first, second and third switching signals being produced under control of said pilot signal, and a matrix means for matrix-operating the output signals supplied from said first, second and third switching circuits and having outputs for providing four output signals.

3. In a four-channel stereophonic receiver for receiving and demodulating a two-channel or a four-channel composite signal, said four-channel composite signal containing a main channel signal component constituted by a first one of four different combinations of signals, said combinations of signals being obtained from four signals stereophonically related to one another; a first sub-channel signal component obtained through suppressed-carrier amplitude modulation of a second one of said combinations of signals; a second sub-channel signal component obtained through suppressed-carrier amplitude modulation of a third one of said combinations of signals on a sub-carrier wave 90° out of phase with respect to said first sub-channel signal component; a third sub-channel signal component obtained through suppressed-carrier amplitude modulation of a fourth one of said combinations of signals, the frequency spectrum of said third sub-channel signal extending to a frequency higher than that of said first and second sub-channel signal; and a pilot signal at a frequency equal to one-half that of said first sub-channel signal, the improvement comprising:

detector circuit means for detecting said third sub-channel signal; and control circit means coupled to the output of said detector circuit and including a time constant circuit and a unidirectional semiconductor element between said detector circuit and said time constant circuit, said semiconductor element being supplied with a DC voltage detected by the detector circuit upon the appearance of said third sub-channel signal at said detector circuit to thereby render said semiconductor element conductive and then allow the DC voltage to immediately be applied to said time constant circuit, while upon disappearance of the third sub-channel signal the semiconductor element is rendered non-conductive but said time constant circuit holds the applied DC voltage for a predetermined period of time, said control circuit means operating in a four-channel state immediately upon the appearance of said third sub-channel signal at the detector circuit, maintaining operation in said four-channel state for a predetermined period of time due to said time-constant circuit and then switching into a two-channel state, said receiver operating in its four- or two-channel state in accordance with the operative state of the control circuit means.

4. A four-channel stereo receiver according to claim 3, in which said detector circuit detects the third sub-channel signal included in the four-channel composite signal, wherein said control circuit means includes a four-channel stereo indicator which is operated by the output of said time constant circuit, said four-channel stereo indicator operating immediately upon appearance of the third sub-channel signal and, upon disappearance of the third sub-channel signal, being kept in the same state for a predetermined period of time and then cut off.

5. A four-channel stereo receiver according to claim 3, which further includes a demodulator means having a first circuit for receiving said four-channel composite signal and being switched by a first switching signal, and a second circuit being supplied with the output of said first circuit for performing detection by a second switching signal, and a matrix means for matrixing output signals supplied from said first and second circuits and having outputs for providing four output signals, the output of said detector circuit being used to allow said second circuit to become operative when a four-channel signal is received and to become non-operative when a two-channel signal is received.

6. A four-channel stereo receiver according to claim 3, in which said control circuit means includes a switch circuit means being turned on and off by the output signal of said time constant circuit which is obtained through said detector circuit means for detecting the third sub-channel signal, and a four-channel demodulator coupled to said switch circuit means, an audio signal being produced immediately upon appearance of the third sub-channel signal at said detector circuit and, upon disappearance of said third sub-channel signal, the production of said audio signal being retained for a predetermined period of time and thereafter shut off.

7. A four-channel stereo receiver according to claim 3, in which said control circuit means includes a switch circuit means being turned on and off by the output signal of said time constant circuit which is obtained through said detector circuit means for detecting the third sub-channel signal, and a demodulator circuit coupling four separated signals to said switch circuit means, said switch circuit means being turned on upon appearance of said third sub-channel signal at the detector circuit and, upon disappearance of said third sub-channel signal being retained in the on state for a predetermined period of time, and thereafter turned off.

8. A four-channel stereo receiver according to claim 3, in which said detector circuit includes a first portion for detecting a fourth one of said combinations of audio signals contained in said third sub-channel of the four-channel composite signal, and a second portion for rectifying an audio frequency signal derived from said first portion, said control circuit means being controlled by the DC output signal of said second portion.

9. A four-channel stereo receiver according to claim 3, in which said receiver comprises a demodulator circuit means which is controlled by said control circuit means to change over to demodulation modes so that it automatically takes a four-channel receiving mode in the operative state of said control circuit means and takes a two-channel receiving mode in the inoperative state of said control circuit means, said demodulating circuit means receiving said four-channel composite signal at its input and producing four signals at its output, said demodulating means operating in the four-channel receiving mode immediately upon appearance of said third sub-channel signal at its input, upon disappearance of the third sub-channel signal retaining the four-channel receiving mode for a predetermined period of time, and then changing into the two-channel receiving mode.

10. A four-channel stereo receiver according to claim 9, in which said demodulator circuit means includes a first switching circuit applied with a signal having the frequency of the first sub-carrier wave, a second switching circuit applied with a signal having the frequency of the second sub-carrier wave, and a third switching circuit applied with a signal having the frequency of the third sub-carrier wave, and a matrix circuit supplied with the output signals from said three switching circuits and generating four outputs, the first, second and third switching circuits being supplied with said composite signal at their inputs, and the second and third switching circuits being supplied with respectively the second and third sub-carrier wave frequency signals immediately upon appearance of said third sub-channel signal at the detector circuit of said control circuit means and, upon disappearance of said third sub-channel signal, the supply of the second and third sub-carrier wave frequency signals being retained for a predetermined period of time and thereafter being cut off.

11. A four-channel stereo receiver according to claim 9, in which said demodulator circuit means includes a first switching circuit applied with a signal having the freqency of the first sub-carrier wave, a second switching circuit applied with a signal having the frequency of the second sub-carrier wave, and a third switching circuit applied with a signal having the frequency of the third sub-carrier wave, and a matrix circuit for receiving the outputs of said three switching circuits and generating four outputs, said first switching circuit being always applied with the input signal, the input signal being supplied to said second and third switching circuits when said third sub-channel signal appears at the detector circuit of said control circuit means and, when it disappears, the supply of the input signal continuing for a predetermined period of time and thereafter being shut off.

12. A four-channel stereo receiver according to claim 9, in which said demodulator circuit means includes a first switching circuit for receiving the four-channel composite signal, and second switching circuits supplied with the output of said first switching circuit, said second switching circuits having output terminals for generating four signal outputs, the first switching circuit being always supplied with a first switching signal, the second switching circuits being supplied with a second switching signal immediately upon appearance of the third sub-channel signal included in the four-channel signal at the detector circuit of said control circuit means and, upon disappearance of said third sub-channel signal, said second switching signal being supplied to said second switching circuits for a predetermined period of time and thereafter being cut off.

13. In a four-channel stereophonic receiver for demodulating a two-channel or a four-channel composite signal, said four-channel composite signal containing a main channel signal component constituted by a first one of four different combinations of signals, said combinations of signals being obtained from four audio signals stereophonically related to one another; a first sub-channel signal component obtained through suppressed-carrier amplitude modulation of a second one of said combinations of signals, a second sub-channel signal component obtained through suppressed-carrier amplitude modulation of a third one of said combinations of signals on a sub-carrier wave 90° out of phase with respect to said first sub-channel signal component, the improvement comprising:

a detector circuit for detecting said second sub-channel signal and demodulating a third one of said combinations of audio signals and rectifying said second one of said combinations of audio signals to obtain a DC voltage, control circuit means coupled to the output of said detector circuit, and including a time constant circuit and a unidirectional semiconductor diode element between said detector circuit and said time constant circuit, said diode element being supplied with the DC voltage detected by the detector circuit upon appearance of said second sub-channel signal at said detector circuit to render the element conducting and allow the DC voltage to immediately be applied to the time constant circuit, while upon disappearance of the second sub-channel signal the element is rendered non-conducting and the time constant circuit holds the applied DC voltage for a predetermined period of time, and switch circuit means constituting a control circuit for controlling the change-over of the four- and two-channel operation modes of the receiver, said switch circuit means being controlled by the DC voltage of the time constant circuit, whereby said switch circuit means is in one operative state immediately upon appearance of said second sub-channel signal at the detector circuit and, upon disappearance of said second sub-channel signal is retained in said operative state for a predetermined period of time and thereafter is changed into another operative state, thus controlling the four- and two-channel operation states of the receiver by said switch circuit means.

14. A four-channel stereo receiver according to claim 13, in which said control circuit further includes an indicator which is turned on by the presence of said second sub-channel signal when a four-channel signal is received, upon disappearance of said second sub-channel the indicator continuing to operate for a predetermined period of time after which it is turned off, said indicator being operated under control of the DC voltage of said time constant circuit.

15. A four-channel stereo receiver according to claim 13, in which the receiver is automatically changed over into the four-channel operation when said second sub-channel signal exists and, when said second sub-channel signal disappears, the four-channel operation is retained for a predetermined period of time after which the four-channel operation is changed into two-channel operation, said four-channel operation being controlled by the DC voltage of said time constant circuit.

16. A four-channel stereo receiver according to claim 13, in which four audio signal outputs are generated at the outputs of four-channel demodulating circuits when the second sub-channel signal exists and, upon disappearance of said second sub-channel signal, the generation of the audio signal outputs is retained for a predetermined period of time after it is shut off, said generation of the audio signal outputs being controlled by the DC voltage of said time constant circuit.

17. A four-channel stereo receiver according to claim 13, in which said control circuit includes a transmitting circuit for transmitting four output signals of the four-channel demodulating circuit which are made operative only when said second sub-channel signal exists and, upon disappearance of said second sub-channel signal their operation state is maintained for a predetermined period of time after which the transmitting circuit is placed in the inoperative state, said transmitting circuit being operated by the DC voltage of said time constant circuit.

18. In a four-channel stereophonic receiver for demodulating a two-channel or a four-channel composite signal, said four-channel composite signal containing a main channel signal component constituted by a first one of four different combinations of signals, said combinations of signals being obtained from four signals stereophonically related to one another; a first sub-channel signal component obtained through suppressed-carrier amplitude modulation of a second one of said combinations of signals; a second sub-channel signal component obtained through suppressed-carrier amplitude modulation of a third one of said combinations of signals on a sub-carrier wave 90° out of phase with respect to said first sub-channel signal component; a third sub-channel signal component obtained through suppressed-carrier amplitude modulation of a fourth one of said combinations of signals, the frequency spectrum of said third sub-channel signal extending to a frequency higher than that of said first and second sub-channel signal; a first pilot signal at a frequency equal to one-half that of said first sub-channel signal; and a second pilot signal the frequency spectrum of which extends to a frequency higher than that of said first sub-channel signal, the improvement comprising:

a detector circuit for detecting said second pilot signal, and demodulating means including first, second and third switching circuits being supplied with said composite signal, the composite signal applied to one of said first, second and third switching circuits having an opposite phase relationship with those applied to the other switching circuits, the first switching circuit being always supplied with a first switching signal of the first sub-carrier wave frequency, the second and third switching circuits including means for applying thereto first and second switching signals of said second and third sub-carrier wave frequency, and matrix means for addition-operating the output signals of said three switching circuits, the second and third switching signals being applied to the second and third switching circuits by the output of said detector circuit when a four-channel signal is received and cut off when a two-channel signal is received.

19. In a four-channel stereophonic receiver for demodulating a two-channel or a four-channel composite signal, said four-channel composite signal containing a main channel signal component constituted by a first one of four different combinations of signals, said combinations of signals being obtained from four signals stereophonically related to one another; a first sub-channel signal component obtained through suppressed-carrier amplitude modulation of a second one of said combinations of signals; a second sub-channel signal component obtained through suppressed-carrier amplitude modulation of a third one of said combinations of signals on a sub-carrier wave 90° out of phase with respect to said first sub-channel signal component; a third sub-channel signal component obtained through suppressed-carrier amplitude modulation of a fourth one of said combinations of signals, the frequency spectrum of said third sub-channel signal extending to a frequency higher than that of said first and second sub-channel signal; a first pilot signal at a frequency equal to one-half that of said first sub-channel signal; and a second pilot signal, the frequency spectrum of which extends to a frequency higher than that of said first sub-channel signal, the improvement comprising:

a detector circuit for detecting said second pilot signal, and demodulating means including first, second and third switching circuits being supplied with said four-channel composite signal, the composite signal applied to one of said first, second and third switching circuits having an opposite phase relationship with respect to those applied to the other switching circuits, means for applying a first sub-carrier frequency signal to said first switching circuit, a second sub-carrier frequency signal to said second switching circuit, and a third sub-carrier frequency signal to said third switching circuit, and matrix means for addition-operating the output signals of said three switching circuits, said matrix means being supplied with output signals of said second and third switching circuits by the output of said detector circuit when a four-channel signal is received and being cut off from the input signals by the output of said detector circuit when a two-channel signal is received.

20. In a four-channel stereophonic receiver for demodulating a two-channel or a four-channel composite signal, said four-channel composite signal containing a main channel signal component constituted by a first one of four different combinations of signals, said combinations of signals being obtained from four signals stereophonically related to one another; a first sub-channel signal component obtained through suppressed-carrier amplitude modulation of a second one of said combinations of signals; a second sub-channel signal component obtained through suppressed-carrier amplitude modulation of a third one of said combinations of signals on a sub-carrier wave 90° out of phase with respect to said first sub-channel signal component; a third sub-channel signal component obtained through suppressed-carrier amplitude modulation of a fourth one of said combinations of signals on a sub-carrier wave at double the frequency of said first and second sub-carrier signal components; a first pilot signal at a frequency equal to one-half that of said first sub-channel signal; and a second pilot signal, the frequency spectrum of which extends to a frequency higher than that of said first sub-channel signal, the improvement comprising:

a detector circuit which detects the second pilot signal, and demodulating means which includes a first circuit being switched by a first switching signal, said first circuit being supplied with said four-channel composite signal, a second circuit supplied with the output of said first circuit and performing detection by a second switching signal, and matrix means for matrixing the outputs of said first and second circuits, said matrix means having outputs for obtaining four output signals, said second circuit being made operative by the output of said detector circuit when a four-channel signal is received and nonoperative when a two-channel signal is received.

21. In a four-channel stereophonic receiver for demodulating a four-channel composite signal containing a main channel signal component constituted by a first one of four different combinations of signals, said combinations of signals being obtained from four signals stereophonically related to one another; a first sub-channel signal component obtained through suppressed-carrier amplitude modulation of a second one of said combinations of signals; at least one signal of the four-channel composite signal such as a second sub-channel signal component; a third sub-channel signal component; and first and second pilot signals, said second sub-channel signal component being obtained through suppressed-carrier amplitude modulation of a third one of said combinations of signals on a sub-carrier wave 90° out of phase with respect to said first sub-channel signal component, said third sub-channel signal component being obtained through suppressed-carrier amplitude modulation of a fourth one of said combinations of signals, the frequency spectrum of which extends to a frequency higher than that of said first and second sub-channel signals, said first pilot signal having a frequency equal to one-half that of said first sub-channel signal and said second pilot signal having a frequency spectrum which extends to a frequency higher than that of said first sub-channel signals, the improvement comprising:

a first detector circuit for detecting one signal of the four-channel composite signal not included in said main channel signal, said first sub-channel signal and said first pilot signal, a second detector circuit for detecting one signal of the two-channel composite signal included in said main channel signal, said first pilot signal and said first sub-channel signal, a comparator circuit supplied with output signals of said first and second detector circuits and operated by an output signal of said first detector circuit only when an output signal of said second detector circuit is above or below a certain level, and control circuit means including a switch circuit and operated by an output signal of said comparator circuit, said receiver operating in its four- or two-channel mode in accordance with the operation of said control circuit means.

22. A four-channel stereo receiver according to claim 21, in which said second detector circuit detects the output of an i.f. amplifier.

23. A four-channel stereo receiver according to claim 21, in which said second detector circuit detects the noise components in the frequency ranges except the frequency spectrum of the four-channel composite signal.

24. A four-channel stereo receiver according to claim 21, in which said first detector circuit detects the second or third sub-channel signal; said second detector circuit detects one signal of the two-channel composite signal included in said main channel signal, said first pilot signal and said first sub-channel signal; and said comparator circuit is operated by the output of said first detector circuit only when the output of said second detector circuit is above or below a certain level, the receiver further comprising a switch circuit operable by said comparator circuit, in which whenever one signal included in the two-channel signal appears at said second detector the switch circuit is rendered in one operative state immediately upon appearance of said second or third sub-channel signal at said first detector, and upon disappearance thereof the switch circuit is retained by that operative state for a predetermined period of time after which it is rendered in another operative state, thereby controlling a four-channel demodulator circuit and a four-channel indicator.

25. A four-channel stereo receiver according to claim 21, in which said first detector circuit detects said second pilot signal, and said second detector circuit detects said first pilot signal.

26. In a four-channel stereophonic receiver for demodulating a two-channel or a four-channel composite signal, said four-channel composite signal containing a main channel signal component constituted by a first one of four different combinations of signals, said combinations of signals being obtained from four signals stereophonically related to one another; a first sub-channel signal component obtained through suppressed-carrier amplitude modulation of a second one of said combinations of signals; a second sub-channel signal component obtained through suppressed-carrier amplitude modulation of a third one of said combinations of signals on a sub-carrier wave 90° out of phase with respect to said first sub-channel signal component; a third sub-channel signal component obtained through suppressed-carrier amplitude modulation of a fourth one of said combinations of signals on a sub-carrier wave at double the frequency of said first and second sub-carrier signal components, and a first pilot signal at a frequency equal to one-half that of said first sub-channel signal, the improvement comprising:

a first detector circuit for detecting second-harmonic signal components of the sub-channel signal of a two-channel composite signal when a two-channel composite signal is being received, said second-harmonic signal having a phase shifted by 90° from that of the third sub-channel signal, a second detector circuit for detecting one signal of the four-channel composite signal including said second and third sub-channel signals when said four-channel composite signal is being received, a comparator circuit supplied with output signals of said first and second detector circuits and operated by an output signal of said second detector circuit only when an output of said first detector circuit is above or below a certain level, and control circuit means including a switch circuit and operated by an output signal of said comparator circuit, said receiver operating in its four- or two-channel mode in accordance with the operation of said control circuit means.

27. A four-channel stereo receiver according to claim 26, in which said receiver comprises a detector circuit including a second detector portion for detecting the third sub-channel signal component and providing an audio frequency signal and a first detector portion for detecting a signal component having a phase 90° shifted from that of the third sub-channel signal, and the output of said first detector portion is controlled on and off by the presence and absence of an output of said second detector portion to control the four-channel operation.

28. In a four-channel stereophonic receiver for demodulating a two-channel or a four-channel composite signal, said two-channel composite signal containing a main channel signal component constituted by a first one of at least two different combinations of signals, said combinations of signals being obtained from at least two signals stereophonically related to one another, a sub-channel signal component obtained through suppressed-carrier amplitude modulation of a second one of said combinations of signals, and a pilot signal at a frequency equal to one-half that of said sub-channel signal, said four-channel composite signal containing a main channel signal component constituted by a first one of four different combinations of signals, said combination of signals being obtained from four signals stereophonically related to one another, a first sub-channel signal component obtained through suppressed-carrier amplitude modulation of a second one of said combinations of signals; a second sub-channel signal component obtained through suppressed-carrier amplitude modulation of a third one of said combinations of signals on a sub-carrier wave 90° out of phase with respect to said first sub-channel signal component; a third sub-channel signal component obtained through suppressed-carrier amplitude modulation of a fourth one of said combinations of signals on a sub-carrier wave at double the frequency of said first and second sub-carrier signal components; and a first pilot signal at a frequency equal to one-half that of said first sub-channel signal, the improvement comprising:

a first detector circuit for detecting one signal of the four-channel composite signal included in said second and third sub-channel signals, a second detector circuit for detecting harmonic signal components of the sub-channel signal of the two-channel composite signal, a comparator circuit supplied with output signals of said first and second detector circuits operated by an output of said first detector circuit only when the output of said second detector circuit is above or below a certain level, and means operative by an output of said comparator circuit for preventing the four-channel operation of said receiver when the harmonic signal components of the sub-channel signal of the two-channel composite signal exist above a predetermined level.

29. In a four-channel stereophonic receiver for demodulating a four-channel composite signal which consists at least of a main channel signal component constituted by a first combination of four signals, a first sub-channel signal component obtained through suppressed-carrier amplitude modulation with a second combination of said four signals, a second sub-channel signal obtained through suppressed-carrier amplitude modulation with a third combination of said four signals with a phase 90° shifted from that of the first sub-channel signal, and a first pilot signal, the improvement comprising:

a first detector circuit for detecting one signal of the four-channel composite signal included in said second sub-channel signal, a second detector circuit for detecting one signal of a two-channel composite signal included in said main channel signal, said first pilot signal and said first sub-channel signal, a comparator circuit supplied with output signals of said first and second detector circuits and operated by an output of said first detector circuit only when an output of said second detector circuit is above or below a certain level, and means operative by the output of said comparator circuit for preventing the four-channel operation of said receiver when said one signal of the two-channel composite signal exists above a predetermined level.

30. A four-channel stereo receiver according to claim 29, in which said second detector circuit detects the output signal of an i.f. amplifier.

31. A four-channel stereo receiver according to claim 29, in which said second detector circuit detects said first pilot signal.

32. A four-channel stereo receiver for demodulating a four-channel signal consisting at least of a main channel signal component constituted by a first combination of the four signals, the first sub-channel signal component obtained through suppressed-carrier amplitude modulation of a second combination of said four signals, the second sub-channel signal obtained through suppressed-carrier amplitude modulation of a third combination of said four signals and being orthogonal to said first sub-channel signal, and a third sub-channel signal obtained through suppressed-carrier amplitude modulated at a frquency twice as large as that of the first sub-carrier wave by a fourth combination of said four signals, and a pilot signal at a frequency equal to one-half that of said first sub-channel signal, comprising:

demodulating means comprising first and third switching circuits supplied with the four-channel composite signal and a second switching circuit supplied with a signal corresponding to said composite signal and 180° out of phase therewith, said first switching circuit being switched by a first switching signal at the first sub-carrier frequency, said second switching circuit by a second switching signal at the second sub-carrier frequency and said third switching circuit by a third switching signal at the third sub-carrier frequency, said first, second and third switching signals being produced under control of said pilot signal, and a matrix means for addition-operating output signals supplied from said first, second and third switching circuits and having outputs for providing four output signals.

33. A four-channel stereo receiver for demodulating a four-channel signal consisting at least of a main channel signal component constituted by a first combination of the four signals the first sub-channel signal component obtained through suppressed-carrier amplitude modulation of a second combination of said four signals, the second sub-channel signal obtained through suppressed-carrier amplitude modulation of a third combination of said four signals and being orthogonal to said first sub-channel signal, and a third sub-channel signal obtained through suppressed-carrier amplitude modulated at a frequency twice as large as that of the first sub-carrier wave by a fourth combination of said four signals, and a pilot signal at a frequency equal to one-half that of said first sub-channel signal, comprising demodulating means comprising first, second and third switching circuits, said first switching circuit being switched by a first switching signal at the first sub-carrier frequency, said second switching circuit by a second switching signal at the second sub-carrier frequency and said third switchiing circuit by a third switching signal at the third sub-carrier frequency, two of said three switching circuits being supplied with said four-channel composite signal and the third of said switching circuits being supplied with a signal corresponding to said composite signal and 180° out of phase therewith, said first, second and third switching signals being produced under control of said pilot signal, and a matrix means for matrix-operating output signals supplied from said first, second and third switching circuits and having outputs for providing four output signals.

34. In a four-channel stereophonic receiver for demodulating a four-channel composite signal containing a main channel signal component constituted by a first one of four different combinations of signals, said combinations of signals being obtained from four signals stereophonically related to one another; a first sub-channel signal component obtained through suppressed-carrier amplitude modulation of a second one of said combinations of signals; at least one signal of the four-channel composite signal such as a second sub-channel signal component; a third sub-channel signal component; and first and second pilot signals, said second sub-channel signal component being obtained through suppressed-carrier amplitude modulation of a third one of said combinations of signals on a sub-carrier wave 90° out of phase with respect to said first sub-channel signal component, said third sub-channel signal component being obtained through suppressed-carrier amplitude modulation of a fourth one of said combinations of signals, the frequency spectrum of which extends to a frequency higher than that of said first and second sub-channel signals, said first pilot signal having a frequency equal to one-half that of said first sub-channel signal and said second pilot signal having a frequency spectrum which extends to a frequency higher than that of said first sub-channel signals, the improvement comprising:

a tuner for receiving said composite signal, said tuner including an intermediate frequency amplifier, a first detector circuit for detecting one signal of the four-channel composite signal not included in said main channel signal, said first sub-channel signal and said first pilot signal, a second detector circuit for detecting the output signal of said intermediate frequency amplifier, a comparator circuit supplied with output signals of said first and second detector circuits and operated by the output signal of said first detector circuit only when the output signal of said second detector circuit is above or below a certain level, and control circuit means including a switch circuit and operated by an output signal of said comparator circuit, said receiver operating in its four- or two-channel mode in accordance with the operation of said control circuit means.

* * * * *